US008596735B2

(12) United States Patent
Koganehira et al.

(10) Patent No.: US 8,596,735 B2
(45) Date of Patent: Dec. 3, 2013

(54) PRINTING SYSTEM AND PROGRAM

(75) Inventors: Shuichi Koganehira, Matsumoto (JP); Taku Ishizawa, Shiojiri (JP); Ryohei Ito, Shiojiri (JP); Masaharu Iwamoto, Shiojiri (JP); Daisuke Nagai, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 50 days.

(21) Appl. No.: 13/215,144

(22) Filed: Aug. 22, 2011

(65) Prior Publication Data

US 2012/0050359 A1 Mar. 1, 2012

(30) Foreign Application Priority Data

Aug. 24, 2010 (JP) ..... 2010-186922
Jan. 13, 2011 (JP) ..... 2011-004591

(51) Int. Cl.
*B41J 2/195* (2006.01)
*B41J 2/175* (2006.01)

(52) U.S. Cl.
USPC ..... 347/7; 347/85; 347/86

(58) Field of Classification Search
None
See application file for complete search history.

(56) References Cited

U.S. PATENT DOCUMENTS 5,434,603 A * 7/1995 Hunt ..... 347/7
6,460,982 B1 10/2002 Ito et al.
7,280,243 B2 10/2007 Kai
7,283,258 B1 10/2007 Kuno et al.
2011/0057971 A1* 3/2011 Yokoyama et al. ..... 347/7

FOREIGN PATENT DOCUMENTS

JP 2000-071568 A 3/2000
JP 2000-211155 A 8/2000
KR 2003-0087958 A 11/2003
KR 2009-0119512 A 11/2009

* cited by examiner

*Primary Examiner* — Geoffrey Mruk
(74) *Attorney, Agent, or Firm* — Kilpatrick Townsend & Stockton LLP

(57) ABSTRACT

Ejection of ink is prohibited when a count value of an amount of ink supplied from an ink tank to an ejection head reaches a value limit. An image is displayed to prompt an operator of the printing apparatus to confirm the amount of ink in the ink tank. When the ink remains, the count value of the amount of ink is returned only by a given amount by the selection of the operator. Thus, since the ink in the ink tank is sufficiently consumed and then the ink can be supplemented, all of the ink in an ink bottle can be supplemented. As a consequence, it is possible to prevent the ink remaining in the ink bottle from deteriorating and prevent the remaining ink from being supplemented.

8 Claims, 16 Drawing Sheets

PRINTING SYSTEM AND PROGRAM

BACKGROUND

1. Technical Field

The present invention relates to a technique for printing an image by ejecting ink from an ejection head.

2. Related Art

Printing apparatuses, such as ink jet printers, which print an image by ejecting ink from an ejection head have been widely used. The ink to be ejected is stored in a dedicated container called an ink cartridge and is supplied to the ejection head by the weight of the ink itself or a liquid sending pump.

The ejection head has a complicated internal configuration in which minute ejection nozzles ejecting the ink and ink passages guiding the ink to the ejection nozzles are formed. Thus, ink is supplied which by its nature deteriorates, so there is a concern that the ejection nozzles, the ink passages, or the like may be clogged and thus the ejection head finally has to be replaced. Accordingly, in order to prevent the ink deteriorating in its nature from being supplied to the ejection head, each ink cartridge is generally replaced with a new ink cartridge when the ink is used up in the ink cartridge. That is, when the ink is used up, the new ink cartridge is mounted. The nature of the ink stored in the ink cartridge is appropriately maintained for a long time as long as the ink cartridge is not mounted. Therefore, the ink with the appropriate nature is normally supplied to the ejection head.

Since the amount of ink stored in the ink cartridge is restricted, the ink cartridge has to be replaced many times after a pause in the printing when an image is printed in large quantities. Accordingly, there has been suggested a technique for realizing continuous printing by supplying ink from an ink tank installed in a printing apparatus and supplementing the ink from a separately prepared ink bottle to the ink tank (see JP-A-2000-211155).

However, when continuous printing is enabled by supplementing ink from the ink bottle or the like, a problem may arise in that the ink deteriorating in its nature is supplemented and the inside of the ejection head is clogged. The reason is as follows. For example, it is supposed that the ink in the ink bottle is supplemented by half. As long as the ink bottle is not opened, the nature of the ink in the ink bottle is appropriately maintained for a long time. However, once the ink bottle is opened, the ink remaining in the ink bottle gradually deteriorates over time. Accordingly, when the remaining half of the ink in the ink bottle is supplemented to the ink tank, the ink deteriorating in its nature is supplied. Therefore, there is a concern that the inside of the ejection head may be clogged.

SUMMARY

An advantage of some aspects of the invention is that it provides a technique for realizing continuous printing by supplementing ink from an ink bottle or the like and preventing the inside of an ejection head from being clogged while supplementing the deteriorating ink.

According to an aspect of the invention, there is provided a program causing a computer to control an operation of a printing apparatus, which includes an ink tank which is able to be supplemented with ink from the outside and an ejection head which ejects the ink supplied from the ink tank and which has a function of stopping ejecting the ink from the ejection head when a count number of an amount of ink supplied from the ink tank to the ejection head reaches a predetermined value limit. The program causes the computer to realize: a first function of acquiring, from the printing apparatus, information used at least to determine whether the count value of the amount of ink reaches the value limit; a second function of displaying a predetermined confirmation image to prompt an operator of the printing apparatus to confirm the amount of ink in the ink tank, when the count value of the amount of ink reaches the value limit; and a third function of instructing the printing apparatus to perform an initialization operation of initializing the count value of the amount of ink or a correction operation of returning the count value from the value limit by a predetermined value depending on selection of the operator of the printing apparatus after the display of the confirmation image.

The program according to the aspect of the invention includes the function of controlling the operation of the printing apparatus that has a function of stopping ejecting the ink when the count number of the amount of ink reaches the predetermined value. First, the information used at least to determine whether the count value of the amount of ink reaches the value limit is acquired from the printing apparatus. Here, when the amount of ink is counted inside the printing apparatus, the amount of ink may be counted by directly measuring the flow rate of the ink supplied to the ejection head. Instead, the amount of ink supplied to the ejection head may be counted indirectly in the operation of ejecting the ink from the ejection head. The amount of ink (and the amount of ink counted by multiplying the amount of ink ejected at one dot by the number of ejection dots) may be counted so that the count number increases or so that the count number decreases, as the ink is supplied to the ejection head. The program according to the aspect of the invention may acquire the information used to determine whether the count value of the amount of ink in the printing apparatus reaches the value limit, and thus may acquire the count value of the amount of ink or may acquire information indicating the magnitude relationship between the count value of the amount of ink and the value limit or information just indicating whether the count value of the ink value reaches the value limit. Further, when it is determined that the count value of the amount of ink reaches the value limit, a predetermined image (confirmation image) is displayed to prompt the operator of the printing apparatus to confirm the actual amount of ink in the ink tank. Thereafter, the operation (initialization operation) of initializing the count value of the amount of ink or the operation (correction operation) of returning the count value by the predetermined value from the value limit is instructed to the printing apparatus depending on the selection of the operator of the printing apparatus.

Thus, when the ink remains in the ink tank but the count value of the amount of ink reaches the value limit due to the influence of an error included in the count value of the amount of ink, the operator of the printing apparatus confirms the amount of ink in the ink tank. When the ink remains in the ink tank, the printing can resume by returning the count value by the predetermined value from the value limit. Therefore, the ink can be supplemented when the ink in the ink tank is used up or the ink is consumed by the amount corresponding to all the ink in the ink bottle in the full state. Therefore, all the ink in the ink bottle can be supplemented. As a consequence, it is possible to prevent the ink remaining in the ink bottle from deteriorating and being supplemented.

In the above-described program according to the aspect of the invention, the following configuration may be realized. The ink tank is configured so that the operator of the printing apparatus can easily confirm the amount of ink in the ink tank and view the position of the ink level in the ink tank. When the count value of the amount of ink reaches the value limit, the confirmation image is displayed to prompt the operator to decide whether the ink is supplemented based on the position of the ink level in the ink tank. As a consequence, when the operator of the printing apparatus selects the supplement of the ink, the printing apparatus may be allowed to perform the initialization operation (operation of initializing the count value). On the other hand, when the operator of the printing apparatus selects the non-supplement of the ink, the printing apparatus may be allowed to perform the correction operation (operation of returning the count value by the predetermined value).

In the above-described program according to the aspect of the invention, the following configuration may be realized. The ink tank is configured so that the operator of the printing apparatus can easily confirm the amount of ink in the ink tank and view the position of the ink level in the ink tank. Further, the lower limit line is marked in the ink tank to determine whether the ink is supplemented by comparing the lower limit line to the position of the ink level. When the count value of the amount of ink reaches the value limit, the position of the ink level in the ink tank is compared to the lower limit line and the confirmation image is displayed to prompt the operator to decide whether the ink is supplemented based on the position of the ink level in the ink tank. As a consequence, when the operator of the printing apparatus selects the supplement of the ink, the printing apparatus may be allowed to perform the initialization operation (operation of initializing the count value). On the other hand, when the operator of the printing apparatus selects the non-supplement of the ink, the printing apparatus may be allowed to perform the correction operation (operation of returning the count value by the predetermined value).

By comparing the lower limit line of the ink tank to the ink level in this way, the operator of the printing apparatus can easily decide whether the ink is supplemented. As a consequence, it is possible to prevent all the ink in the ink bottle from being supplemented and prevent the remaining ink from deteriorating in the ink bottle due to erroneous decision of the ink supplement.

In the above-described program according to the aspect of the invention, the following configuration may be realized. First, the ink tank is configured so that a predetermined amount of ink is stored as the reserved ink even below the lower limit line marked in the ink tank. When the operator of the printing apparatus decides that the ink is not supplemented by comparing the lower limit line to the ink level, the printing apparatus may be allowed to perform the operation of returning the count value of the amount of ink in the printing apparatus by the count value corresponding to the amount of the reserved ink from the value limit.

Since the ink level is located substantially at the same position as the lower limit line, it is decided that the ink is not supplemented. Therefore, even when the count value of the amount of ink is returned, the printing can continuously be performed using the reserved ink in the ink tank until the count value reaches the value limit again. As a consequence, it is possible to prevent the ejection head from being considerably damaged due to the idle ejection.

In the above-described program according to the aspect of the invention, the following configuration may be realized. First, the plurality of ink tanks are mounted on the printing apparatus and each of the ink tanks is provided with the ejection head. When the amount of ink is counted, the amount of ink is counted for each ink tank. When the count value of the amount of ink in any one of the ink tanks reaches the value limit, the confirmation image (image used to allow the operator of the printing apparatus to confirm whether the ink is supplemented into the ink tank) for the ink tank is displayed. As a consequence, the printing may be allowed to perform the initialization operation or the correction operation for each ink tank displayed with the confirmation image depending on the selection of the operator of the printing apparatus for each ink tank.

Thus, even in the printing apparatus performing an image using the plural kinds of ink, the printing can continuously be performed until the ink in the individual ink tanks is sufficiently consumed.

The above-described aspect of the invention may be realized in the printing apparatus of which the operation is controlled in accordance with the above-described program or in a printing system configured by a computer or the like executing the program. Alternatively, the above-described program may be realized in the printing system combined with the printing apparatus.

According to an aspect of the invention, there is provided the printing system including: a printing unit allowing an ejection head to eject ink supplemented from the outside to an ink tank; and a control unit controlling an operation of the printing unit. The control unit includes an ink amount count unit counting an amount of ink supplied from the ink tank to the ejection head in the printing unit, an ejection stop unit stopping ejecting the ink from the ejection head, when a count value of the amount of ink reaches a predetermined value limit, a confirmation image display unit displaying a predetermined confirmation image to prompt an operator of the printing system to confirm the amount of ink in the ink tank, when the count value of the amount of ink reaches the value limit, and a count value change unit performing an operation of returning the count value of the amount of ink up to an initial value of the count value or returning the count value from the value limit by a predetermined value depending on selection of the operator of the printing system after the display of the confirmation image.

In the printing system according to the aspect of the invention, when the amount of ink supplied from the ink tank to the ejection head is counted and the count value reaches the predetermined value limit, the ejection of the ink from the ejection head is stopped and the confirmation image for prompting the operator to confirm the amount of ink in the ink tank is displayed. When the amount of ink remains in the ink tank, the count value of the amount of ink counted in the printing apparatus is returned by the predetermined value from the value limit, and the ink can be ejected again from the ejection head. When the computer controlling the printing apparatus is connected to the printing apparatus to print an image, the computer, which is connected to the printing apparatus, or the control unit, which is mounted on the printing apparatus, having the function of stopping ejecting the ink from the ejection head corresponds to the control unit according to the aspect of the invention. An element which does not correspond to the control unit according to the aspect of the invention corresponds to the printing unit according to the aspect of the invention. When the printing apparatus itself is mounted with the computer and thus an image is printed without connection to an external computer, the computer mounted on the printing apparatus corresponds to the control unit according to the aspect of the invention and the other element corresponds to the printing unit according to the aspect of the invention.

Even in the printing system according to the aspect of the invention, as in the program according to the aspect of the invention, the ink can be supplemented after the ink in the ink tank is sufficiently consumed without the influence of the error included in the count value of the amount of ink in the printing apparatus.

In the printing system according to the aspect of the invention, the lower limit line may be marked in the ink tank and the ink may be supplemented from the ink bottle to the ink tank. A relationship between the ink capacity stored in the ink tank and the ink capacity stored in the unopened ink bottle may be a relationship in which the ink tank can be filled with all the ink in the unopened ink bottle when the ink level in the ink tank is located at the lower limit line.

Thus, it is possible to prevent all the ink in the ink bottle from being not supplemented and remaining and prevent the ink deteriorating in the ink bottle from being supplemented at the next time.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment will be described in the following order to clarify the details of the above-described invention.

A. Configuration of Apparatus

A-1. Configuration of Ink Jet Printer According to Embodiment

A-2. Configuration of Printing System according to Embodiment

B. Remaining Ink Amount Management Process

B-1. Remaining Ink Amount Correction Process

B-2. Ink Supplement Process

A. Configuration of Apparatus

A-1. Configuration of Ink Jet Printer According to Embodiment

Figure 1:
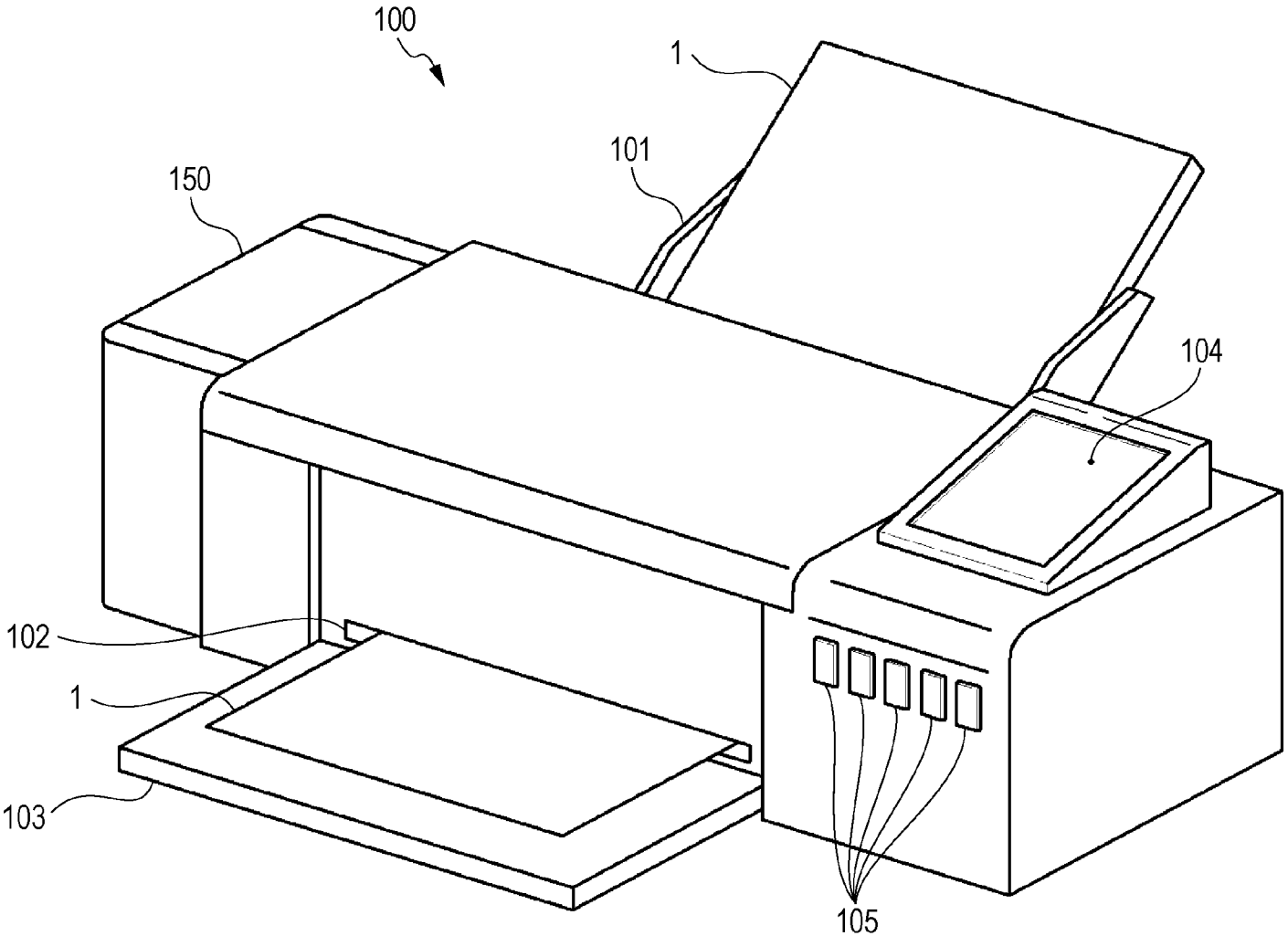
FIG. 1 is a diagram illustrating an ink jet printer which is a printing apparatus according to an embodiment.

FIG. 1 is a diagram illustrating an ink jet printer 100 which is a printing apparatus according to this embodiment. The ink jet printer 100 shown in FIG. 1 has a substantially box-like appearance. A front surface cover 103 is installed in the substantial middle of the front surface and a sheet-feeding tray 101 accommodating a print sheet 1 is installed on the rear side. A plurality of operation buttons 105 are installed at the position corresponding to the vicinity of the front surface cover 103 on the front surface of the ink jet printer 100. A touch panel type monitor screen 104 is installed on the upper surface of the portion in which the operation buttons 105 are installed. The front surface cover 103 is axially supported at the lower end. When the upper end of the front surface cover 103 falls down to the front side, a vertically long sheet-discharging port 102 that discharges the print sheet 1 appears. When the print sheet 1 is loaded in the sheet-feeding tray 101 and the monitor screen 104 or the operation buttons 105 is operated, the print sheet 1 is fed from the sheet-feeding tray 101. Then, after an image is printed on the surface of the print sheet 1 inside the ink jet printer 100, the print sheet 1 is discharged from the sheet-discharging port 102.

A box-like tank case 150 is installed on the side surface of the ink jet printer 100. As described in detail below, a plurality of ink tanks are installed inside the tank case 150 and ink to be used in printing by the ink jet printer 100 is supplied from the ink tanks.

Data (image data) regarding an image to be printed is subjected to image processing by a computer 200 connected to the ink jet printer 100, and then is supplied to the ink jet printer 100. When the ink jet printer 100 receives the image data subjected to the image processing from the computer 200, the ink jet printer 100 converts the image data into dot data indicating whether dots are formed with ink on the print sheet 1 and form the dots by ejecting the ink onto the print sheet 1 in accordance with the obtained dot data. As a consequence, an image is printed on the print sheet 1. That is, in this embodiment, a printing system 10 includes the ink jet printer 100 and the computer 200 that performs predetermined image processing on the image data and supplies the processed image data to the ink jet printer 100.

A-2. Configuration of Printing System According to Embodiment

Figure 2:
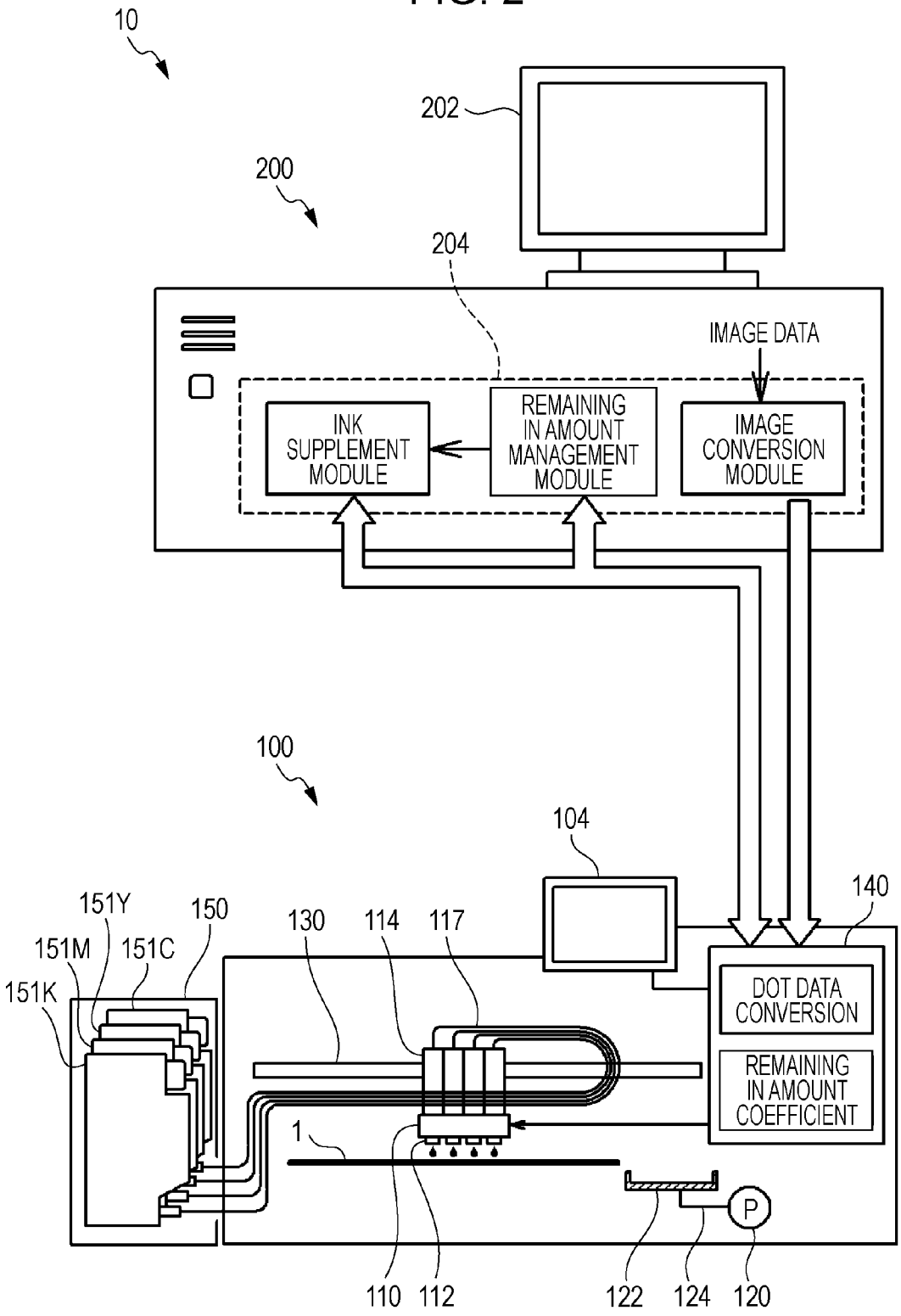
FIG. 2 is a diagram illustrating the overall configuration of the printing system according to the embodiment.

FIG. 2 is a diagram illustrating the overall configuration of the printing system 10 according to this embodiment. The general internal configuration of the ink jet printer 100 is shown in FIG. 2. First, the internal configuration of the ink jet printer 100 will be described in brief. As shown in FIG. 2, a carriage 110 reciprocating above the print sheet 1 is installed inside the ink jet printer 100. Ejection heads 112 ejecting ink are installed in the carriage 110. The ink jet printer 100 according to this embodiment is capable of printing an image using ink of four colors, that is, cyan (hereinafter, referred to as C), yellow (hereinafter, referred to as Y), magenta (hereinafter, referred to as M), and black (hereinafter, referred to as K). The ejection heads 112 for respective ink colors are provided in correspondence to the ink of the four colors.

The carriage 110 is driven by a driving mechanism (not shown) to reciprocate above the print sheet 1 while being guided along a guide rail 130. The ink jet printer 100 further includes a sheet-feeding mechanism (not shown) which feeds the print sheet 1 little by little with reciprocation movement of the carriage 110. The image is printed on the print sheet 1 by ejecting ink of a C color (hereinafter, referred to as C ink), ink of a Y color (hereinafter, referred to as Y ink), ink of an M color (hereinafter, referred to as M ink), and ink of a K color (hereinafter, referred to as K ink) from the ejection heads 112 with the reciprocation movement and the carriage 110 and the sheet-fed movement of the print sheet 1.

The ink to be ejected from the ejection head 112 is stored in ink tanks 151 installed in the tank case 150. Since the four kinds of ink of the C ink, the Y ink, the M ink, and the K ink are used in the ink jet printer 100 according to this embodiment, the ink tanks 151 are installed for the kinds of ink. That is, there are provided the four ink tanks 151: the ink tank 151C for the C ink, the ink tank 151Y for the Y ink, the ink tank 151M for the M ink, and the ink tank 151K for the K ink. In the specification, when it is not necessary to distinguish the kinds of ink from each other, the ink tanks 151C, 151Y, 151M, and 151K for the respective kinds of ink are simply referred to as the ink tanks 151. The ink of these ink tanks 151 is supplied to the ejection heads 112 for the respective kinds of ink via ink tubes 117 for the kinds of ink.

Further, a region called a home position is formed at the position at which the carriage 110 is moved along the guide rail 130 up to the outside of the print sheet 1. While the ink jet printer 100 does not print an image, the carriage 110 is moved to the home position. A cap 122 is installed at the home position. The cap 122 is movable vertically by an elevation mechanism (not shown). When the carriage 110 is moved to the home position and the cap 122 is pressed against the bottom surface of the carriage 110 at this state, closed spaces are formed so as to cover the ejection heads 112, thereby preventing the ink in the ejection heads 12 from drying. A negative pressure pump 120 is connected to the cap 122 via a negative tube 124. Therefore, when the cap 122 is pressed against the bottom surface of the carriage 110 and the negative pressure pump 120 is operated at this state, the ink in the ejection heads 112 can be sucked out. Therefore, even when the ink becomes dry in the ejection heads 112 and the viscosity of the ink increases, the ink can be sucked out so as to maintain the appropriate viscosity of the ink in the ejection heads 112.

The ink jet printer 100 includes a control unit 140 that includes a CPU performing a logical operation or an arithmetic operation, a ROM and an EEPROM storing various kinds of programs or data, and a RAM in which the CPU temporarily stores data. The control unit 140 converts an image represented by image data into image data (dot data) expressed by dots of the ink, when the control unit 140 receives the image data subjected to the image processing from the computer 200. An operation of reciprocating the carriage 110, an operation of feeding the print sheet 1, and an operation of forming the dots by ejecting the ink by the ejection heads 112 are controlled in accordance with the dot data. When the dots of the ink are formed, the amount of ink is consumed and the amount of ink remaining in the ink tank 151 gradually decreases. Accordingly, the control unit 140 according to this embodiment counts the remaining amounts of ink in the ink tanks 151 for the kinds of ink based on the dot data for the kinds of ink, respectively and stores the counted remaining amounts of ink in the EEPROM. Therefore, when the remaining amounts of ink reach a predetermined value (value limit) (the ink is used up computationally), the control unit 140 stops the operation of ejecting the ink from the ejection heads 112. Thus, since the ejection heads 112 are driven in a state where no ink is supplied, it is possible to prevent the ejection heads 112 from being considerably damaged.

The computer 200 executes the various kinds of programs stored in the ROM, since the CPU, the ROM, the RAM, and the like are connected to each other via a bus to perform data communication. Further, the computer 200 further includes a monitor screen 202. A program called a printer driver 204 is stored among the plurality of programs stored in the ROM. When an operator (who is also operator of the ink jet printer 100) of the computer 200, that is, is a user who uses the printing system 10 that includes the computer 200 and the ink jet printer 100, and is simply referred to as an operator below) perform printing of a document through a document generation application or the like, the CPU operates the printer driver 204. The printer driver 204 performs predetermined image processing on the image data to be printed and outputs the processed image data to the ink jet printer 100.

The operations of the printer driver 204 according to this embodiment can be classified, in terms of its function, into an operation (image conversion module) regarding a function of performing image processing on the image data to be printed, an operation (remaining ink amount management module) regarding a function of managing the remaining amounts of ink in the ink tanks 151 by communicating with the ink jet printer 100, an operation (ink supplement module) regarding a function of supplementing the ink to the ink tanks 151 by activation by the remaining ink amount management module, and the like. Here, the term "modules" are a virtual concept in which the operations of the printer driver 204 are generally classified in terms of the function and are actually realized in various forms. For example, the module may be embodied as a program code group in which a plurality of commands is arranged to realize a desired function or may be embodied as an LSI group which realizes a desired function by hardware.

As described above, the image conversion module performs the predetermined image processing on the image data of an image to be printed and outputs the processed image data to the ink jet printer 100. However, this process is the same as a process executed by a general printer driver, the description thereof will be omitted herein. In the printer driver 204 according to this embodiment, the remaining ink amount management module (or the ink supplement module) guides the operator in regard to an operation performed in the printing system 10 to prevent the ink jet printer 100 from performing printing due to ink shortage by performing a remaining ink amount management process described below during the data communication with the ink jet printer 100. Further, the remaining ink amount management module also guides the operator in regard to an operation in the printing system to prevent the inside of the ejection heads 112 from being clogged due to the supplement of the ink of an abnormal nature. Hereinafter, a process performed in order to realize these functions by the remaining ink amount management module in the printer driver 204 according to this embodiment will be described.

B. Remaining Ink Amount Management Process

Figure 3:
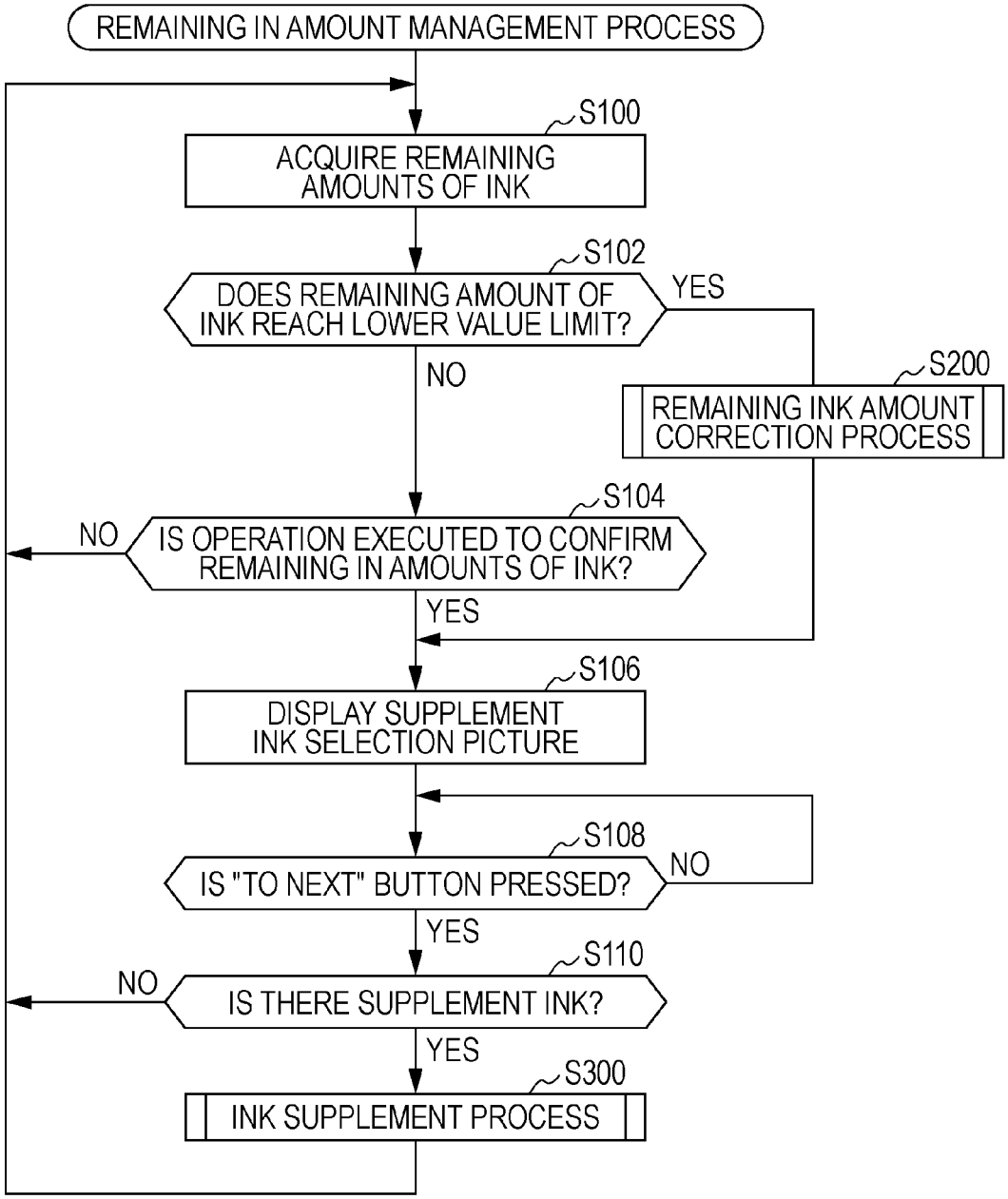
FIG. 3 is a flowchart illustrating a remaining ink amount management process executed by a printer driver according to the embodiment.

FIG. 3 is a flowchart illustrating the remaining ink amount management process performed in the printer driver 204 according to this embodiment. The remaining ink amount management process is a process that is performed by the remaining ink amount management module of the printer driver 204 during the communication with the control unit 140 of the ink jet printer 100.

In the remaining ink amount management process, as shown in FIG. 3, the remaining amounts of ink the ink tanks 151 for the respective kinds of ink are first acquired from the control unit 140 of the ink jet printer 100 (step S100). As described with reference to FIG. 2, the control unit 140 of the ink jet printer 100 converts the image data received from the computer 200 into the dot data (image data in which an image is expressed by ink dots), controls the operations or the like of the ejection heads 112 or the carriage 110, counts the remaining amounts of ink the ink tanks 151 based on the dot data, and accumulate and stores the counted remaining amounts of ink. The amounts of ink sucked out from the ejection heads by the negative pressure pump in order to clean the ejection heads are also included when the remaining amounts of ink are counted. Hereinafter, the remaining amounts of ink in the respective ink tanks counted by the control unit 140 and stored in the EEPROM are simply referred to as the remaining amounts of ink or count values of the amounts of ink. Further, in processes described below, description made in regard to the kinds of ink without specifying the kinds of ink are assumed to be description made in regard to all the ink.

When the remaining amounts of ink are acquired from the control unit 140 of the ink jet printer 100, it is determined whether the acquired remaining amounts of ink reach a predetermined lower value limit (step S102). When the remaining amount of ink in any one of the ink tanks 151 reaches the predetermined lower limit (yes in step S102), a remaining ink amount correction process (step S200) starts. As described in detail below, the remaining ink amount correction process refers to a process of confirming the remaining amount of ink in the ink tank 151 to the operator and correcting the remaining amount of ink counted by the control unit 140 of the ink jet printer 100 when the ink actually remains.

On the other hand, when the remaining amounts of ink acquired from the ink jet printer 100 do not yet reach the lower limit (no in step S102), it is determined whether a predetermined operation of confirming the remaining amounts of ink is executed by the operator (step S104). The predetermined operation of confirming the remaining amounts of ink refers to an operation of activating the printer driver 204 in the computer 200 by the operator, opening a window for the printer driver, and clicking a button to confirm the remaining amounts of ink. As a consequence, when the operator does not execute this operation of confirming the remaining amounts of ink (no in step S104), the process returns to the initial process, the remaining amounts of ink are acquired from the ink jet printer 100 (step S100), and then the above-described series of processes are reiterated.

On the other hand, when the operator executes the predetermined operation to confirm the remaining amounts of ink (yes in step S104), the remaining ink amount management module displays a picture, which displays the rough remaining amounts of ink in the ink tanks 151 based on the remaining amounts of ink acquired from the control unit 140 so that the ink (supplement ink) to be supplemented is selected, on the monitor screen 202 of the computer 200 (step S106).

Figure 4:
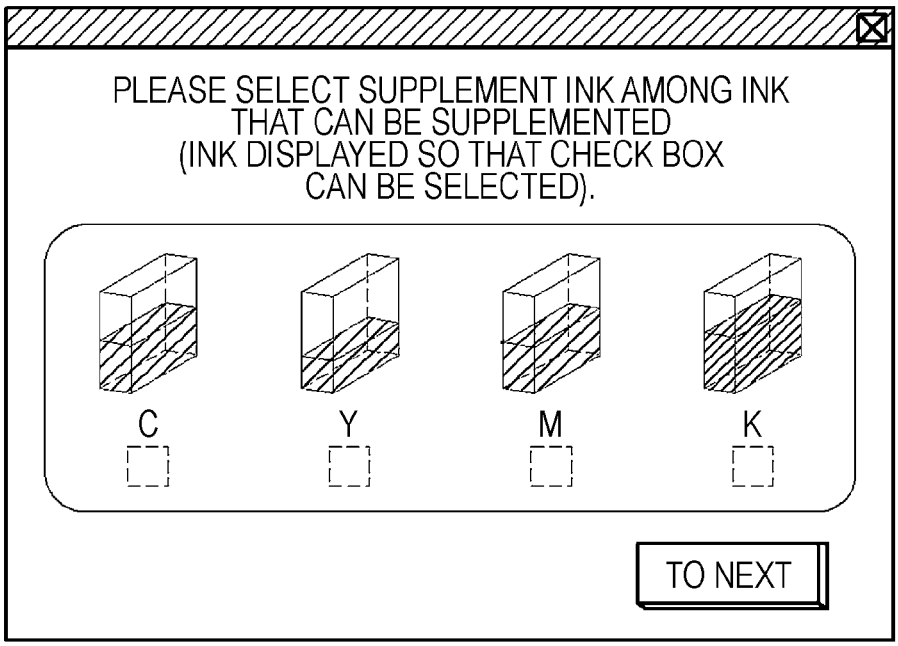
FIG. 4 is a diagram illustrating a supplement ink selection picture displayed on a monitor screen.

FIG. 4 is a diagram illustrating a supplement ink selection picture displayed on the monitor screen 202. As shown in FIG. 4, images indicating the rough remaining amounts for C ink, Y ink, M ink, and K ink, respectively, are displayed on the supplement ink selection picture. A check box is displayed below the image indicating the rough remaining amount of ink. Therefore, the operator can check the check box and select the ink tank to which the ink is supplement. In regard to the ink for which the remaining amount of ink is not lowered, the ink does not need to be supplemented. Accordingly, the check box is displayed so as not to be selected for this ink. In FIG. 4, the check box indicated by a dashed line among the check boxes of the respective C, Y, M, and K ink is the check box which cannot be selected.

Figure 5:
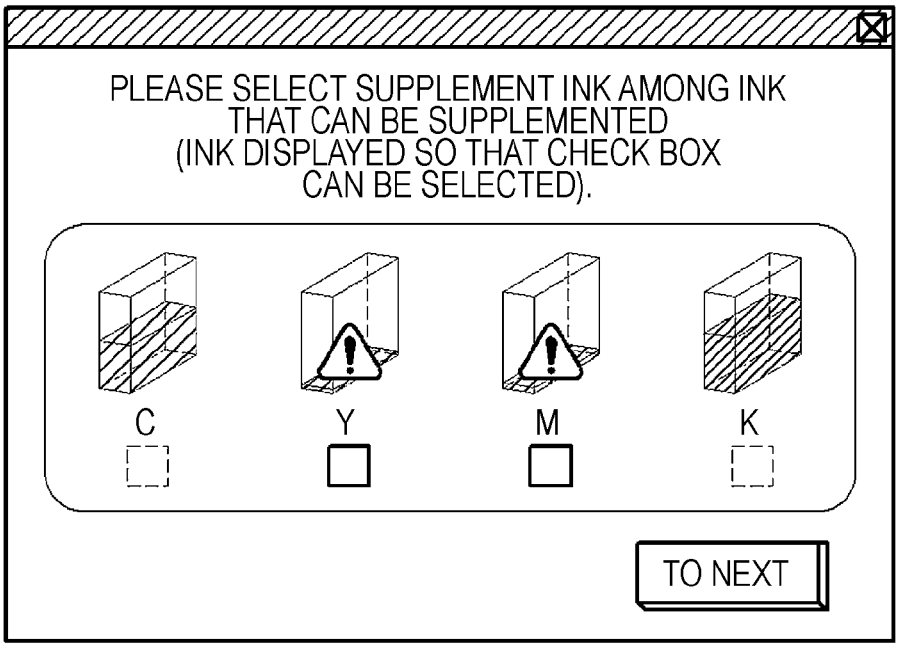
FIG. 5 is a diagram illustrating another form of the supplement ink selection picture displayed on the monitor screen.

FIG. 5 is a diagram illustrating another form of the supplement ink selection picture displayed on the monitor screen 202. In the example shown in FIG. 5, the remaining amounts of Y ink and M ink are lowered up to a predetermined value (3% or less of the full state), and thus the check boxes for the Y ink and the M ink are displayed so as to be selected. The check box indicated by a thick solid line in the drawing is the check box displayed so as to be selected. Since the ink of which the remaining amount of ink is lowered up to a value equal to or less than the predetermined value is displayed together with a "!" mark combined inside a triangle overwritten on the image indicating the rough remaining amount of ink, it is easy to recognize that the remaining amount of ink is lowered. In FIG. 5, the case has been exemplified in which the remaining amounts of Y ink and M ink are lowered up to the value equal to or less than the predetermined value. Further, when the remaining amount of another ink (for example, the C ink) is lowered to a value equal to or less than the predetermined value, the check box for the ink (C ink) is displayed so as to be selected and the "!" mark combined inside the triangle is overwritten on the image indicating the rough remaining amount of ink (C ink).

As described above, when the operator executes the predetermined operation to confirm the remaining amounts of ink in the remaining ink amount management process shown in FIG. 3 (yes in step S104) and there is consequently no ink of which the remaining amount of ink is lowered to a value equal to or less than the predetermined value, the supplement ink selection picture is displayed, as in FIG. 4. On the contrary, when there is the ink of which the remaining amount of ink is lowered to a value equal to or less than the predetermined value, the supplement ink selection picture exemplified in FIG. 5 is displayed (step S106). When the supplement ink selection picture is displayed, as in FIG. 4, all of the check boxes are displayed so as not to be selected. Therefore, the operator can select a button (hereinafter, referred to as a "TO NEXT" button) displayed with "TO NEXT" located in the lower right corner of the picture. On the other hand, when the supplement ink selection picture is displayed, as in FIG. 5, the operator can checks the check box for the ink which the operator attempt to supplement, and then can select a "TO NEXT" button located in the lower right corner of the picture. Of course, when the operator does not attempt to supplement any ink, the operator can select the "TO NEXT" button without checking the check box for any ink.

In the remaining ink amount management process in FIG. 3, when the supplement ink selection picture exemplified in FIG. 4 or 5 is displayed on the monitor screen 202 (step S106), "no" is determined in step S108 and a standby state continues until the operator clicks the "TO NEXT" button. Then, when the operator presses down the "TO NEXT" button, the remaining ink management module of the printer driver 204 detects the pressing (yes in step S108), and then determines whether there is the ink (the ink checked in the check box on the supplement ink selection picture) selected so as to be supplemented (step S110). As a consequence, when there is the ink tank (ink to be supplemented) for the ink selected so as to be supplemented by the operator (yes in step S110), an ink supplement process described below starts (step S300).

On the other hand, when the supplement ink selection picture is displayed, as in FIG. 4, so that the ink is not selectable or when the supplement ink selection picture is displayed, as in FIG. 5, so that the ink is selectable but any ink is not selected, it is determined that there is no ink to be supplemented in step S110 (no in step S110). In this case, the process returns to the initial process of the remaining ink amount management process without performing the ink supplement process described below, the remaining amounts of ink are acquired from the ink jet printer 100 (step S100), and then the above-described series of processes are reiterated.

The process has hitherto been described in which the supplement ink selection picture is displayed when the predetermined operation is executed to confirm the remaining amounts of ink by the operator of the printing system 10 (yes in step S104). In this way, when the predetermined operation is executed by the operator, the supplement ink selection picture is displayed on the monitor screen 202 of the computer 200 to display the rough remaining amounts of ink at any time irrespective of the values of the remaining amounts of ink acquired from the ink jet printer 100. On the other hand, when the remaining ink amount management module determines that the remaining amounts of ink from the ink jet printer 100 reach the predetermined lower value limit (yes in step S102), the remaining ink amount correction process described below starts (step S200). First, a picture is automatically displayed on the monitor screen to display the rough remaining amounts of ink. Hereinafter, the remaining ink amount correction process will be described.

B-1. Remaining ink Amount Correction Process

Figure 6:
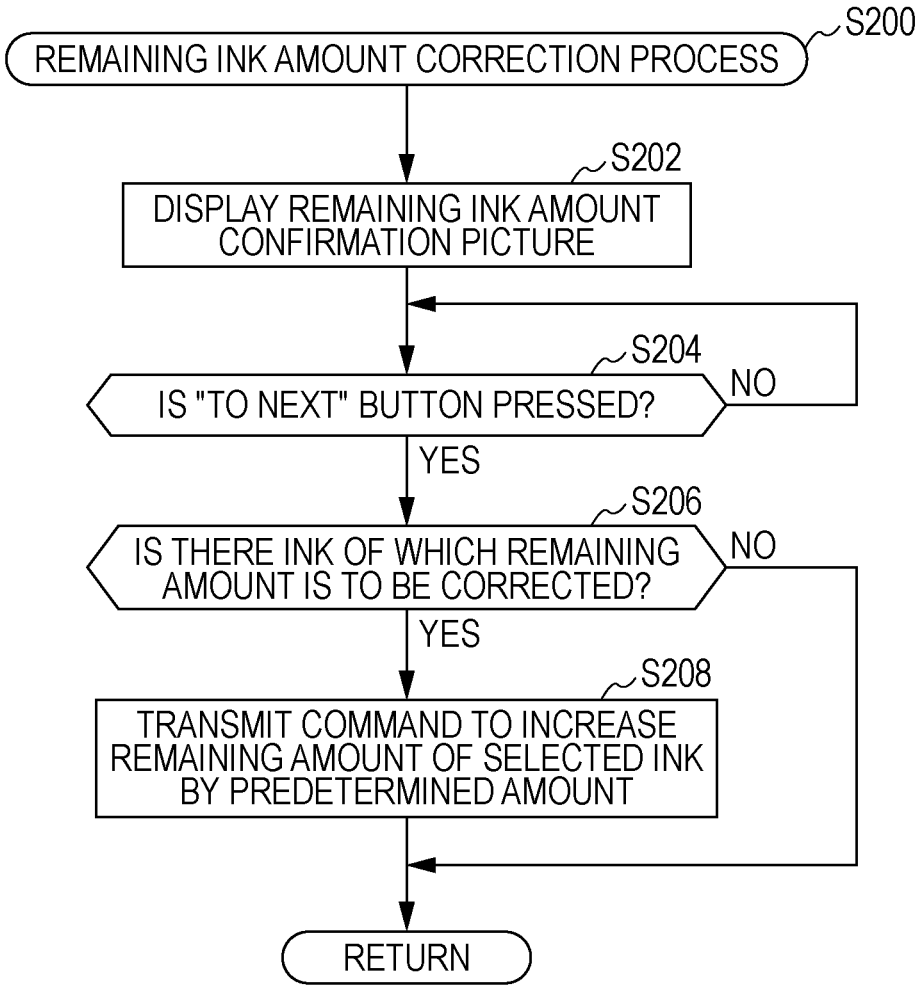
FIG. 6 is a flowchart illustrating a remaining ink amount correction process executed during a remaining ink amount management process.

FIG. 6 is a flowchart illustrating the remaining ink amount correction process. The remaining ink amount correction process refers to a process that is performed by the remaining ink amount management module (see FIG. 2) of the printer driver 204 when it is determined that any one of the remaining amounts of ink reaches the predetermined lower value limit (yes in step S102 in FIG. 3).

When the remaining ink amount correction process starts, as shown in FIG. 6, a remaining ink amount confirmation picture is first displayed on the monitor screen 202 of the computer 200 (step S202). Here, the remaining ink amount confirmation picture refers to a picture that prompts the operator to view the ink levels of the ink tanks 151 and confirm the remaining amounts of ink remaining actually in the ink tanks 151. Hereinafter, the remaining amount of ink actually remaining in the ink tank is referred to as the actual remaining amount of ink. The remaining ink amount confirmation picture will be described in detail below.

The reason for prompting the operator to visually view and confirm the actual remaining amount of ink is as follows. First, the remaining amount of ink acquired from the ink jet printer 100 by the printer driver 204 is the remaining amount of ink that is calculated by adding the amount of ejected ink (ejected-amount of ink) measured based on the dot data for printing by the control unit 140 of the ink jet printer 100 and the amount of ink sucked for cleaning from the ejection head 112 and by accumulating the ejected-amounts of ink. However, since the amount of actually ejected ink is varied depending on the use environment (for example, the ambient temperature) of the ink jet printer 100 and the individual difference of the ink jet printer 100, some error is included in the ejected-amount of ink. Further, as the error is accumulated, the calculated remaining amount of ink may differ from the actual remaining amount of ink. Thus, when the calculated remaining amount of ink reaches the lower value limit, it is possible to confirm whether the actual remaining amount of ink reaches the lower value limit in such a manner that the operator visually views and confirms whether the ink level is lowered up to the lower limit line.

Figure 7:
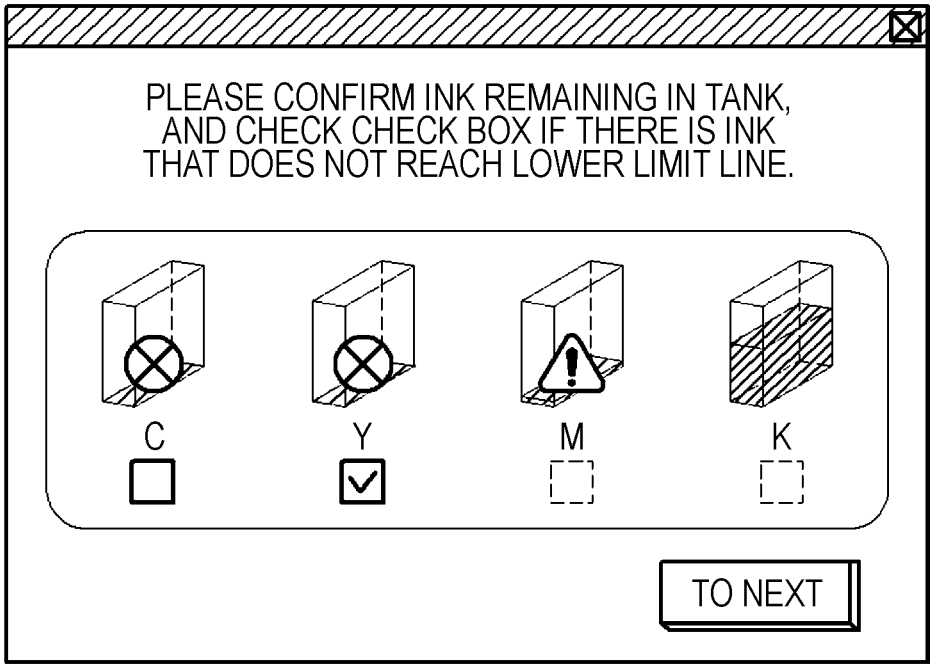
FIG. 7 is a diagram illustrating a remaining ink amount confirmation picture displayed on the monitor screen.

FIG. 7 is a diagram illustrating an example of a remaining ink amount picture displayed on the monitor screen 202. As shown in FIG. 7, the rough remaining amounts of C ink, Y ink, M ink, and K ink are displayed on the remaining ink amount picture, as in the supplement ink selection picture described above with reference to FIG. 4 or 5. By confirming an image of each remaining amount of ink, it is possible to easily know whether the calculated remaining amount of ink reaches the lower value limit. For example, an "X" mark combined inside a circle is overwritten on each of images indicating the remaining amounts of C ink and Y ink displayed in the drawing, and thus the fact that the remaining amounts of the respective ink are lowered up to the lower value limit (the ink tanks 151 become nearly empty) is indicated. Further, a "!" mark combined inside a triangle is overwritten on an image indicating the remaining amount of M ink. This mark indicates that the remaining amount of ink is lowered up to an ink supplement level, as in the supplement ink selection picture described above with reference to FIG. 5. No mark is overwritten on an image indicating the remaining amount of K ink, and thus the fact that the remaining amount of ink is not lowered up to the ink supplement level is indicated.

A square check box is displayed below the image indicating the remaining amount of each ink. Further, a message of "Please confirm the amount of ink remaining in the ink tank 151, and check the check box if there is the ink that does not reach the lower limit line" is displayed above the image indicating each remaining amount of ink in order to prompt the operator to confirm the remaining amount of ink. As described above with reference to FIG. 1, the ink tanks 151 are accommodated inside the tank case 150 and a confirmation window described below is installed in the tank case 150. Accordingly, the operator can easily confirm the remaining amount of ink in each ink tank 151.

Figure 8:
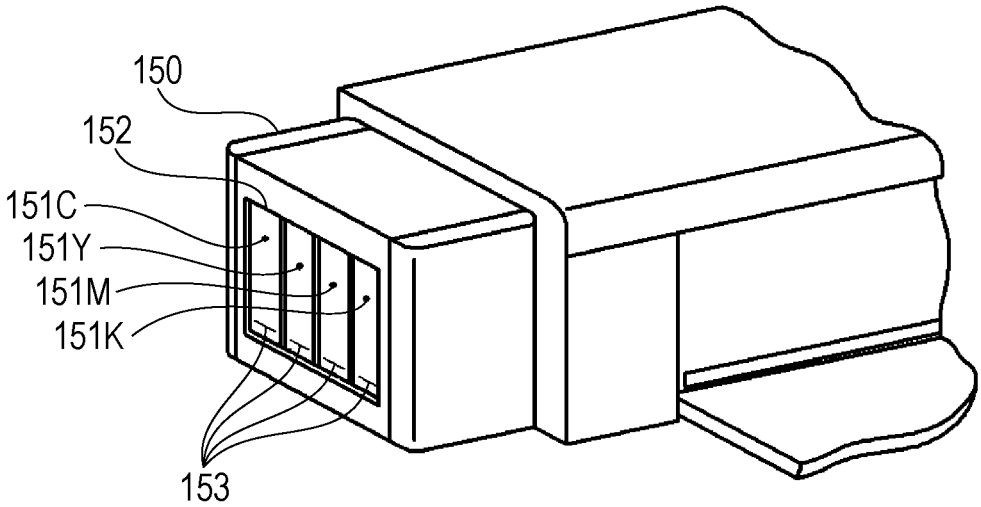
FIG. 8 is a diagram illustrating the remaining amounts of ink in ink tanks when confirmed from a confirmation window of a tank case.

FIG. 8 is a diagram illustrating the ink jet printer 100 when viewed from the confirmation window 152 installed in the tank case 150. The operator can confirm the actual remaining amount of ink in the ink tank 151 through the confirmation window 152. As shown in FIG. 8, the large confirmation window 152 is formed on the side surface of the tank case 150. Therefore, the operator can view the ink tank 151C for the C ink, the ink tank 151Y for the Y ink, the ink tank 151M for the M ink, and the ink tank 151K for the K ink accommodated in the tank case 150. The ink tanks 151C, 151Y, 151M, and 151K are made of a transparent or semi-transparent resin material. Therefore, the operator can visually view and confirm the position of the ink level remaining in each of the ink tanks 151C, 151Y, 151M, and 151K.

As shown in FIG. 8, a lower limit line 153 is marked in each of the ink tanks 151C, 151Y, 151M, and 151K. The lower limit line 153 corresponds to the "lower value limit" referred to determine the remaining amount of ink in the remaining ink amount management process shown in FIG. 3. That is, the lower limit line 153 is set as a position at which the ejected-amount of ink is subtracted from the fullness state of the ink tank 151 based on the dot data and the ink level in the ink tank 151 is just lowered when the remaining amount of ink lowered up to the lower value limit. That is, the lower limit line 153 is set in such a manner that the ejected-amount of ink is subtracted from the remaining amount of ink (remaining amount of ink of 100%) corresponding to the actual amount of ink in the ink tank at the time of initially filling the ink tank 140 with all the ink of the ink bottle from the ink bottle by the control unit 140, when the standard ink jet printer 100 is used under a predetermined environment, and the position of the actual ink level of the ink tank 151 is located slightly higher than the lower limit line, when the remaining amount of ink is lowered up to the predetermined lower limit.

Figure 9:
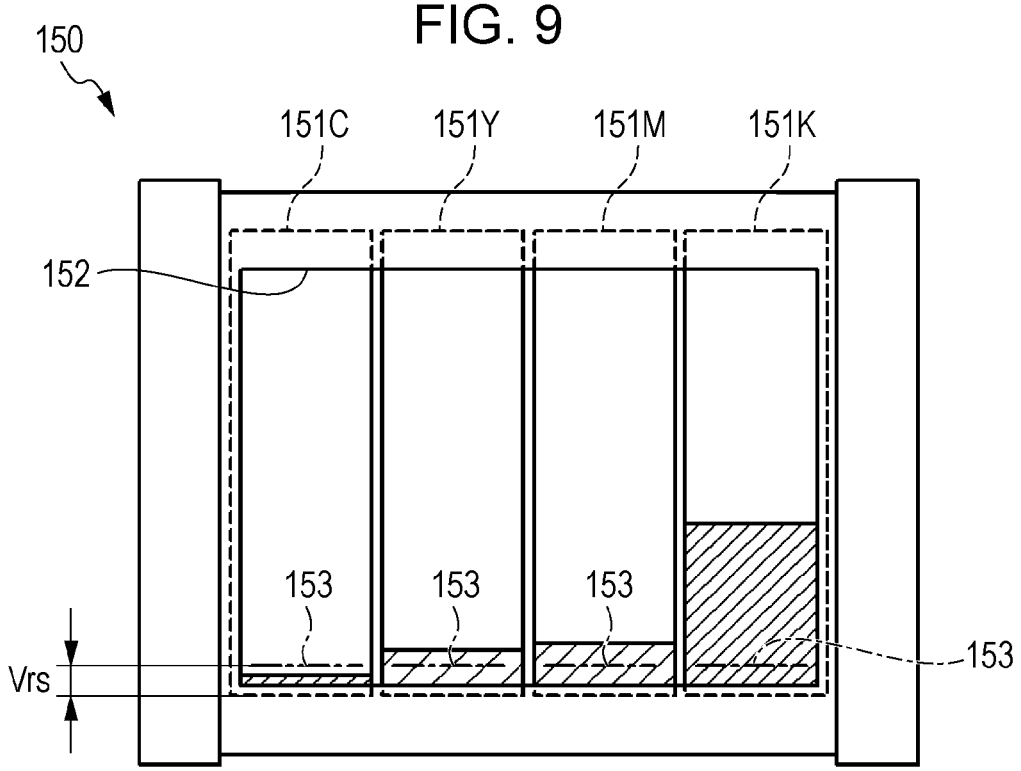
FIG. 9 is a diagram illustrating the positions of ink levels in the ink tanks when confirmed from the confirmation window of the tank case.

FIG. 9 is a diagram illustrating the positions of the ink levels in the ink tanks 151 when confirmed from the confirmation window 152 of the tank case 150. A dashed line shown in the drawing indicates the ink tank 151 accommodated in the tank case 150. Since the ink tank 151 is made of a transparent or semi-transparent resin material, as described above, the position of the ink level in the ink tank 151 can be visually viewed and confirmed. As indicated by a chain line shown in the drawing, the operator can visually view and confirm the lower limit line 153 formed in the ink tank 151 from the confirmation window 152. Accordingly, the operator can easily confirm whether the ink level in each ink tank 151 reaches the lower limit line 153.

As shown in FIG. 9, the lower limit line 153 of the ink tank 151 is formed at the position slightly higher than the bottom surface of the ink tank 151. That is, the position of the lower limit line 153 is set such that the ink of a given amount (Vrs) remains as reversed ink in the ink tank 151 even when the ink level reaches the lower limit line 153. The reason that the lower limit line 153 of the ink tank 151 is set in this way is described in detail below.

In this embodiment, as described above, when the remaining ink amount management module determines that the remaining amount of ink calculated by the control unit 140 is lowered up to the predetermined lower value limit, the remaining ink amount confirmation picture exemplified in FIG. 7 is displayed, and thus the operator can confirm whether the position of the ink level in each ink tank 151 reaches the lower limit line 153 from the confirmation window 152. As a consequence, when the calculated remaining amount of ink is lowered up to the lower value limit (that is, it is considered that the ink level reaches the lower limit line 153), but the ink level does not actually reach the lower limit line 153, the check box of the corresponding ink is configured to checked on the picture in FIG. 7.

In the example shown in FIG. 7, the ink of which the calculated remaining amount of ink is lower than the lower value limit is two kinds of ink: the C ink and the Y ink and only the check boxes for the ink are displayed so as to be selectable. On the contrary, the check boxes of the ink (the M ink and the K ink) of which the calculated remaining amount of ink does not reach the lower value limit are displayed so as not to be selectable. As for the Y ink between the C ink and the Y ink, as shown in FIG. 9, it is considered that the actually confirmed ink level does not reach the lower limit line 153, and thus the operator is configured to check the check box (see FIG. 9). In this way, the operator visually views and confirms the position of the ink level of each ink from the confirmation window 152 of the tank case 150, and checks the check box depending on the confirmation result, and then clicks the "TO NEXT" button displayed below the picture.

Then, in the remaining ink amount correction process shown in FIG. 6, it is determined that the "TO NEXT" button is pressed down (yes in step S204). The remaining ink amount confirmation picture shown in FIG. 7 is displayed on the monitor screen 202, and "no" is determined in step S204, and a standby state is maintained.

When it is determined that the "TO NEXT" button is pressed down (yes in step S204), it is determined whether there is the ink (that is, the ink checked in the check box on the remaining ink amount confirmation picture in FIG. 7) of which the calculated remaining amount of ink needs to be corrected (step S206). As a consequence, when there is the ink of which the calculated remaining amount of ink needs to be corrected (yes in step S206), an instruction to correct the remaining amount of ink is given by transmitting a command to the control unit 140 of the ink jet printer 100 (step S208). The control unit 140 receiving the command increases the remaining amount of corresponding ink only by a predetermined amount. In this way, even when a deviation occurs between the calculated remaining amount of ink and the actual remaining amount of ink remaining in the ink tank 151, it is possible to approach the calculated remaining amount of ink to the actual remaining amount of ink. On the other hand, when there is no ink of which the calculated remaining amount of ink needs to be corrected (no in step S206), the remaining ink amount correction process in FIG. 6 immediately ends without correction of the remaining amount of ink and the process returns to the remaining ink amount management process in FIG. 3.

In this embodiment, it is estimated that the amount of ink ejected from the ejection head 112 is slightly larger than the actual amount of ink. Therefore, the calculated remaining amount of ink is set to be normally less than the remaining amount of ink actually remaining in the ink tank 151. This is because it is possible to reliably prevent a case where printing may not continue due to ink shortage by prompting preparation of the supplement ink quickly when the ink remains. On the other hand, in the remaining ink amount management process in FIG. 3, the remaining ink amount correction process starts so that the operator confirm the actual ink level, only when the calculated remaining amount of ink reaches the predetermined lower value limit (yes in step S102 of FIG. 3).

In some cases, the calculated remaining amount of ink may be greater than the actual amount of ink remaining in the ink tank 151. Accordingly, when the remaining amount of ink does not yet reach the lower value limit on the remaining ink amount confirmation picture in FIG. 7 irrespective of the fact that the actual ink level is lowered up to the lower limit line 153, the operator may match the calculated remaining amount of ink with the actual remaining amount of ink by reducing the calculated remaining amount of ink on the monitor screen 202. For example, the user may click and drag a bar of the remaining amount of ink displayed on the screen and adjust the height of the bar.

Hereinafter, the reason that the ink level reaches the lower limit line 153 but the lower limit line 153 is set at the position at which the reversed ink of the given amount (Vrs) remains in the ink tank 151 will be described. In this embodiment, as described above, when the calculated remaining amount of ink reaches the lower value limit, the operator is prompted to visually view the position of the ink level of the ink tank 151 and confirm whether the actual remaining amount of ink really reaches the lower value limit. In most cases, by comparing the position of the ink level to the lower limit line 153, it is easy to determine whether the remaining amount of ink reaches the lower value limit. However, when the position of the ink level is very close to the lower limit line 153, the situation is a little different.

Figure 10:
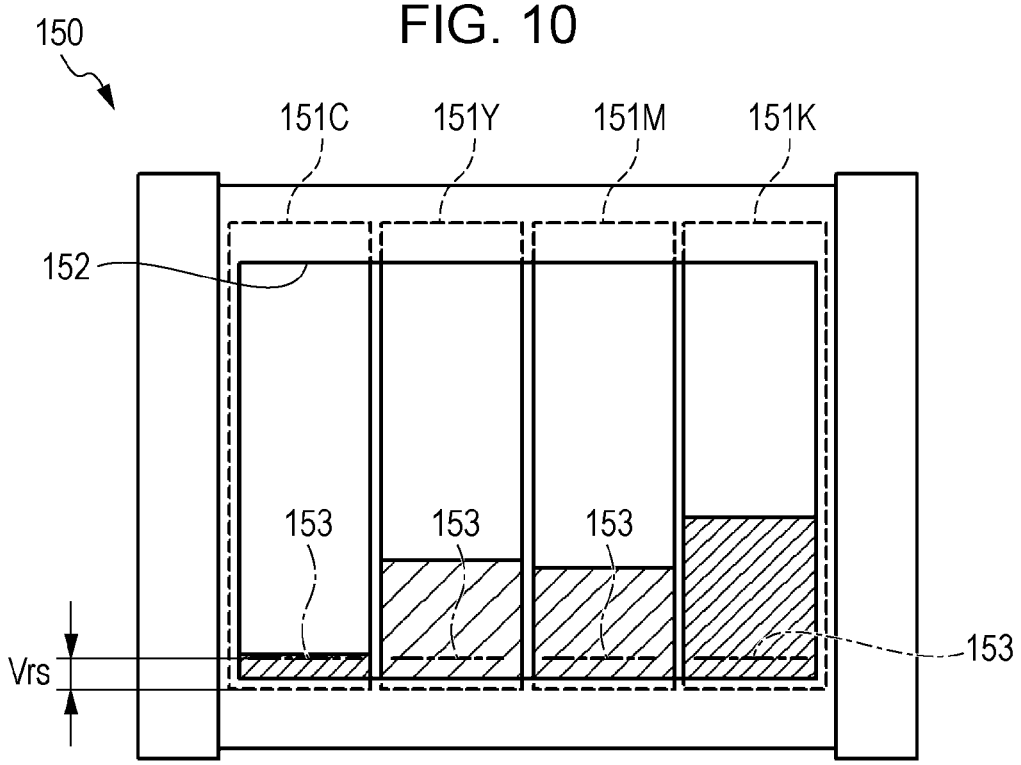
FIG. 10 is a diagram illustrating a case where the ink level is very close to a lower limit line.

FIG. 10 is a diagram illustrating a case where the position of the ink level in the ink tank 151 is very close to a lower limit line 153. In the example shown in FIG. 10, the position of the ink level of the C ink (the ink of the most left ink tank 151C on the sheet surface) is very close to the lower limit line 153. In this case, the positional relationship between the ink level and the lower limit line 153 may be reversely viewed depending on whether the operator views the ink tank 151 from the upper side or lower side of the ink level. Alternatively, when the tank case 150 is slightly tilted or the ink tank 151 is slightly tilted inside the tank case 150, the ink level is actually lower than the lower limit line 153 but the ink level may appear to be higher than the lower limit line 153. Further, when the ink level just overlaps the lower limit line 153, there are cases where the operator may check or may not check the check box.

When the ink level is actually lower than the lower limit line 153 but the operator misjudges that the ink level is higher than the lower limit line 153 and thus checks the check box on the remaining ink amount confirmation picture in FIG. 7, the command is transmitted from the printer driver 204 to the ink jet printer 100 and thus the calculated remaining amount of ink (here, the C ink) increases by a predetermined amount (step S208 in FIG. 6). As a consequence, the control unit 140 of the ink jet printer 100 determines that the ink remains in the ink tank 151 (here, the ink tank 151C) until the calculated remaining amount of ink reaches the lower value limit again, and continues driving the ejection head 112. Further, when the calculated remaining amount of ink reaches the lower value limit again and the ink is used up in the ink tank 151, the ejection head 112 idly ejects the ink and may be considerably damaged.

When the ink level is obviously lower than the lower limit line 153, as in the C ink exemplified in FIG. 9 but the check box is checked on the remaining ink amount confirmation picture in FIG. 7, it can be considered that the operator does not confirm the instruction on the remaining ink amount confirmation picture. Therefore, there is no choice even when the ejection head 112 is considerably damaged. However, for the operator, the ink level appears to be higher than the lower limit line 153, as in the C ink exemplified in FIG. 10. Therefore, when the check box is checked on the remaining ink amount confirmation picture, the operator just executes the operation in accordance with the instruction on the remaining ink amount confirmation picture. Even in this case, the fact that the ejection head 112 is damaged is a problem.

In order to prevent this problem, the reserved ink of the given amount (Vrs) is configured to remain in the ink tank 151 below the lower limit line 153. The amount of reversed ink is the amount of ink (or the amount of ink slightly larger than the amount of reversed ink) corresponding to the remaining amount of ink increasing in the ink jet printer 100, when the operator checks the check box on the remaining ink amount confirmation picture in FIG. 7. Therefore, when the ink level becomes very close to the lower limit line 153, the calculated remaining amount of ink reaches the lower value limit before consumption of the reserved ink and the remaining ink amount confirmation picture is displayed again in spite of the fact that the operator checks the check box on the remaining ink amount confirmation picture in FIG. 7. In this step, the ink level is obviously lower than the lower limit line 153, there is no concern that the operator erroneously checks the check box on the remaining ink amount confirmation picture. As a consequence, it is possible to prevent the ejection head 112 from being considerably damaged due to the idle ejection.

In this way, when the remaining amount of ink is corrected in the remaining ink amount correction process in FIG. 7 (step S208 in FIG. 7), and then the process returns to the remaining ink amount management process in FIG. 3, the supplement ink selection picture is displayed on the monitor screen 202 of the computer 200 (step S106 in FIG. 3). That is, when the remaining amount of ink reaches the lower value limit, the remaining ink amount confirmation picture in FIG. 7 is automatically displayed without any operation of the operator. Then, when the operator selects the "TO NEXT" button in the lower right corner of the picture, the supplement ink selection picture is displayed at this time.

Figure 11:
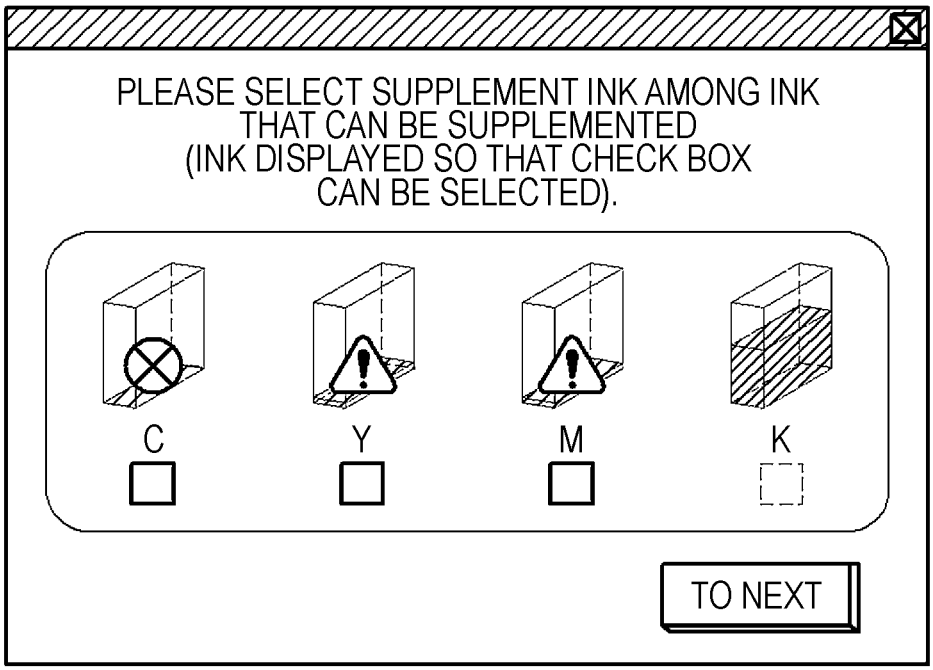
FIG. 11 is a diagram illustrating an example of the supplement ink selection picture displayed after the remaining ink amount confirmation picture.

FIG. 11 is a diagram illustrating an example of the supplement ink selection picture displayed after the remaining ink amount confirmation picture. The basic configuration of the supplement ink selection picture shown in FIG. 11 is the same as the supplement ink selection picture described above with reference to FIG. 4 or 5. However, the supplement ink selection picture shown in FIG. 4 or 5 is a picture displayed, when the operator executes the predetermined operation before the remaining amount of ink reaches the lower limit. Therefore, the image (image with a "X" mark combined inside a circle) indicating that the remaining amount of ink reaches the lower value limit is not displayed for any ink. On the contrary, the image indicating that the remaining amount of ink reaches the lower value limit is displayed on the supplement ink selection picture displayed after the remaining ink amount confirmation picture, as exemplified in FIG. 11. This is because the operator visually views and confirms the remaining amount of ink on the remaining ink amount confirmation picture exemplified in FIG. 7 and the supplement ink selection picture is consequently displayed without correction of the remaining amount of ink of which the ink level is lowered up to the lower limit line 153.

In the example shown in FIG. 11, since the check box for the C ink may not be checked on the remaining ink amount confirmation picture in FIG. 7, the image indicating that the remaining amount of ink reaches the lower value limit is displayed even on the supplement ink selection picture in FIG. 11. On the contrary, since the check box for the Y ink can be checked on the remaining ink amount confirmation picture in FIG. 7, the image (image with a "!" mark combined inside a triangle) indicating that the ink can be supplement is displayed instead on the supplement ink selection picture in FIG. 11 even though the remaining amount of ink does not reach the lower value limit on the supplement ink selection picture in FIG. 11.

As described above, when the operator of the ink jet printer 100 checks the check box on the supplement ink selection picture in FIG. 11 and selects the ink to be supplemented and then selects the "TO NEXT" button displayed in the lower right corner of the picture, the ink supplement process (step S300) of supplementing the ink starts. That is, the remaining ink amount management module determines that the operator checks the check box for the ink which the operator desires to supplement and presses down the "TO NETT" button, the ink supplement module is operated. Here, it is assumed that the operator selects the C ink and the M ink on the supplement ink selection picture.

B-2. Ink Supplement Process

Figure 12:
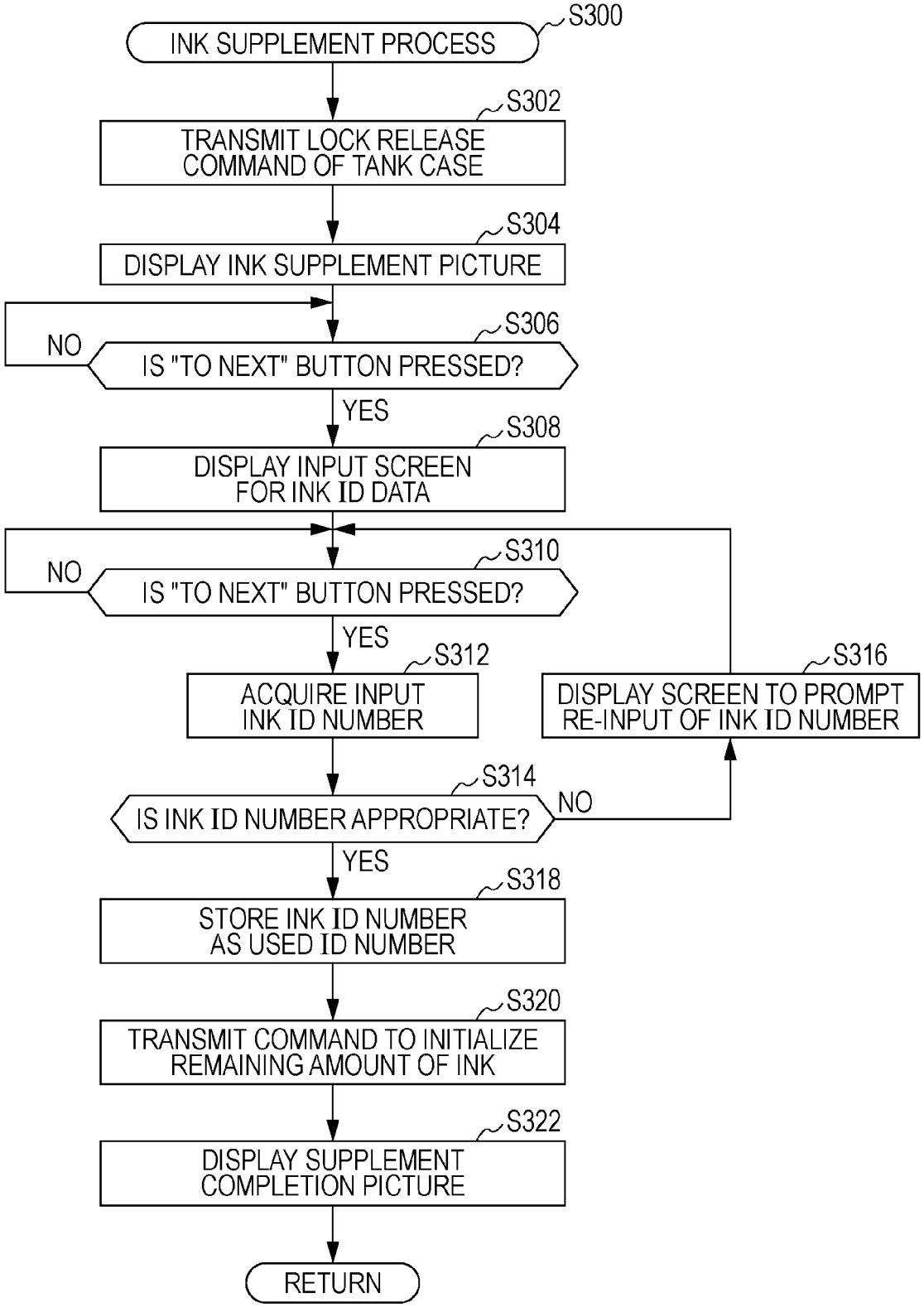
FIG. 12 is a flowchart of an ink supplement process performed in the remaining ink amount management process.

FIG. 12 is a flowchart of the ink supplement process. The ink supplement process is a process which is performed in the remaining ink amount management process by the printer driver 204 of the computer 200. Specifically, the ink supplement process is performed by the ink supplement module. When the ink supplement process (step S300) starts, as shown in FIG. 12, a command (lock release command) for releasing lock of the tank case 150 is transmitted to the ink jet printer 100 (step S302). The reason is as follows.

That is, as shown in FIG. 1, the tank case 150 is separately configured from the ink jet printer 100 and is mounted to the side surface of the ink jet printer 100. At a normal time, the tank case 150 is in a lock state where the tank case 150 is not detachable from the ink jet printer 100. However, when the tank case 150 is mounted on the ink jet printer 100, the ink may not be supplemented to the ink tank 151 in the tank case 150. Accordingly, when the ink is supplemented, the lock release command is transmitted from the computer 200 to the ink jet printer 100 in order to detach the tank case 150. When the control unit 140 of the ink jet printer 100 receives the lock release command, the lock state of the tank case 150 is released by moving an actuator (not shown) built in the ink jet printer 100. As a consequence, the tank case 150 enters the state where the operator can detach the tank case 150.

Figure 13:
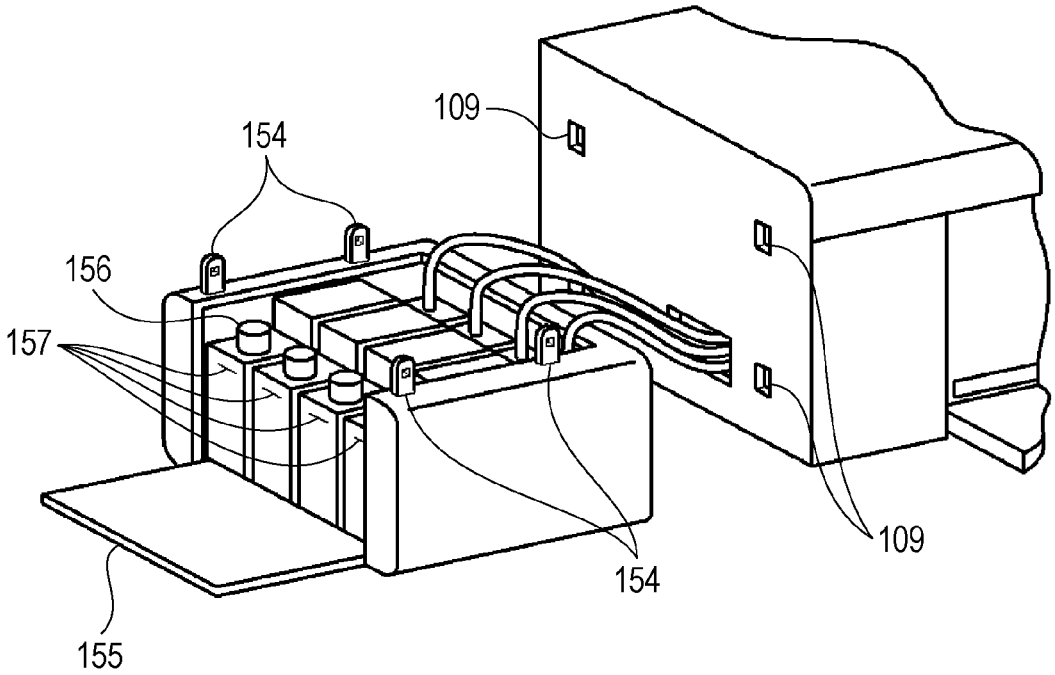
FIG. 13 is a diagram illustrating the tank case detached from the ink jet printer.
Figure 14:
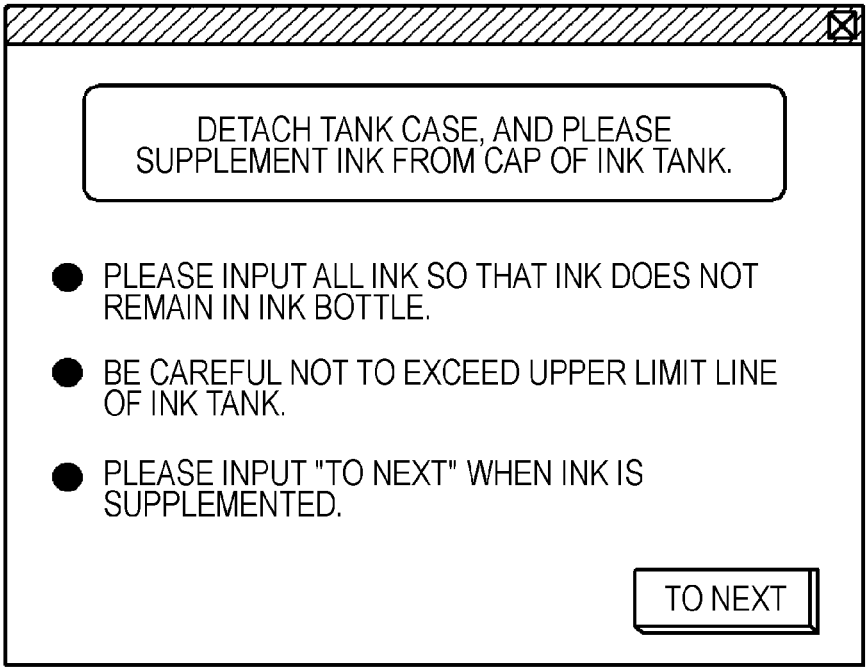
FIG. 14 is a diagram illustrating an example of an ink supplement picture displayed on the monitor screen.

FIG. 13 is a diagram illustrating the tank case 150 detached from the ink jet printer 100. In FIG. 13, the tank case 150 is detached, and then the tank case 150 is rotated so that the side surface of the tank case 150 mounted to the ink jet printer 100 faces upward. As shown in FIG. 14, small protrusions 154 are erected at four positions on the mounting surface of the tank case 150 mounted on the ink jet printer 100. On the surface of the ink jet printer 100, insertion holes 109 for the protrusions 154 are formed at the corresponding positions.

When the tank case 150 is mounted on the ink jet printer 100, the protrusions 154 are inserted into the insertion holes 109 so as to match the positions of the protrusions 154 with the positions of the insertion holes 109. Then, the portions of through-holes of the front ends of the protrusions 154 fits with lock mechanisms (not shown) installed inside the insertion holes 109 to enter the lock state, and thus the tank case 150 is mounted. When the tank case 150 is detached, an upper surface cover 155 installed in the upper surface of the tank case 150 can be made to fall down. When the upper surface cover 155 is made to fall down, as shown in FIG. 13, the ink tanks 151 appear. Accordingly, upper limit lines 157 marked the side surfaces of the respective ink tanks 151 can visually be viewed and confirmed. As shown in FIG. 13, caps 156 installed on the upper surfaces of the ink tanks 151 can easily be detached by falling down the upper surface cover 155 in the state where the tank case 150 is rotated.

When the printer driver 204 of the computer 200 transmits the lock release command to the ink jet printer 100 in this way and thus the lock state of the tank case 150 is released (step S302 in FIG. 12), the ink supplement picture is displayed on the monitor screen 202 of the computer 200 (step S304).

FIG. 14 is a diagram illustrating an example of the ink supplement picture displayed on the monitor screen 202. As shown in FIG. 14, the ink supplement picture displays a message for prompting the operator to detach the tank case 150 and supplement the ink from the caps 156 (see FIG. 13) of the ink tanks 151. Caution statements for the ink supplement are displayed below the message. That is, a caution statement where all the ink of an ink bottle 160 described below is supplemented so that the ink does not remain in the ink bottle 160 is displayed or a caution state where it is careful so that the ink level does not exceed the upper limit line 157 (see FIG. 13) marked in the ink tank 151 is displayed.

Figure 15:
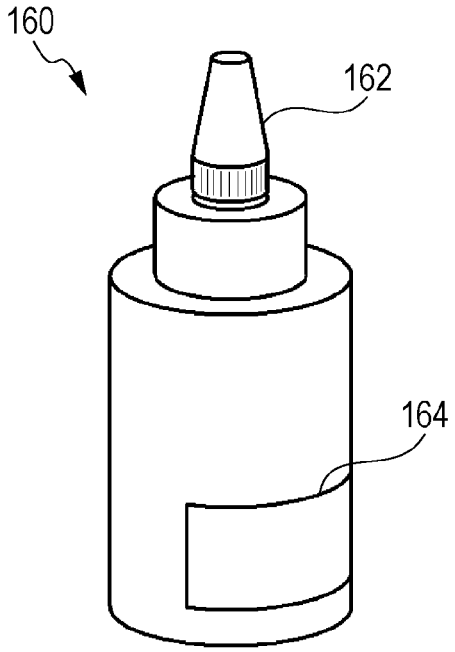
FIG. 15 is a diagram illustrating an example of an ink bottle storing supplement ink.

FIG. 15 is a diagram illustrating the ink bottle 160 which stores supplement ink. The ink bottle 160 is a substantially cylindrical container made of a resin material excellent in an airtight property or a light-shielding property and the cap 162 is installed on the top of the container. A label 164 made of paper is attached on the side surface of the ink bottle 160 an ink ID number described below is printed on the outside of the label 164.

As for the inside of the ink bottle 160 according to this embodiment, the inside of the ink bottle 160 is maintained airtightly in a state where the cap 162 is fixed to the ink bottle 160. When the cap 162 is wrenched off to supplement the ink, a vertically long pour opening appears from the inside. Thus, after the tank case 150 is detached, as in FIG. 13, the cap 156 installed in each ink tank 151 is opened and the ink in the ink bottle 160 is injected.

Here, when all the ink in the ink bottle 160 is injected in the state where the ink level of the ink tank 151 is lowered up to the lower limit line 153, the ink tank 151 becomes nearly full and has the amount of ink so that the ink level does not exceed the upper limit line. Further, the cap 162 of the ink bottle 160 is just fixed to the ink bottle 160. Therefore, once the cap 162 is detached from the ink bottle 160, the cap 162 is configured so as not be mounted again. Accordingly, the operator spontaneously supplement all the ink in the ink bottle 160 into the ink tank 151 according to the caution statement which is displayed on the ink supplement picture shown in FIG. 14 and in which all the ink in the ink bottle 160 is supplemented.

When the operator supplements all the ink necessary to be supplemented in this way, the operator selects the "TO NEXT" button displayed in the lower right corner of the ink supplement picture in FIG. 14. Then, in the ink supplement process in FIG. 12, the ink supplement module determines that the "TO NEXT" button is pressed down (yes in step S306) and displays a picture to prompt the operator to input the ink ID number of the supplemented ink on the monitor screen 202 (step S308). After the ink supplement picture is displayed (step S302), "no" is determined and a standby state is maintained until the operator clicks the "TO NEXT" button in step S306.

Figure 16:
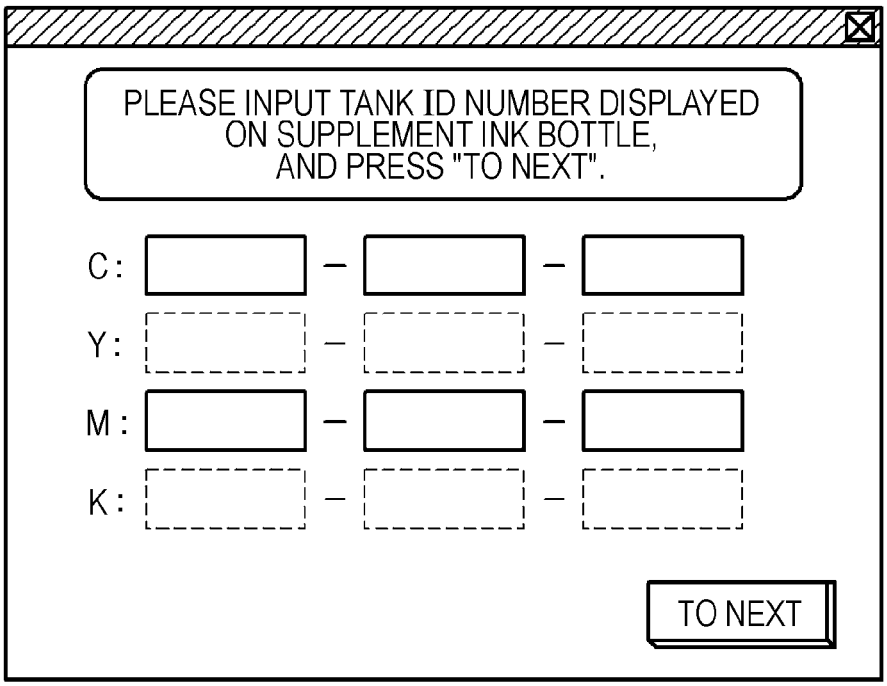
FIG. 16 is a diagram illustrating an example of an ink ID number input picture displayed on the monitor screen.

FIG. 16 is a diagram illustrating an example of an ink ID number input picture displayed on the monitor screen 202. As shown in FIG. 16, input boxes are displayed on the ink ID number input picture in a state where the ink ID number can be input for the ink (the ink which the operator selects so as to be supplemented) which is determined to be supplemented in the above-described supplement ink selection process. In the example shown in FIG. 16, the input boxes for the C ink and the M ink are displayed in the state where the ink ID number can be input. Further, the input boxes are displayed in a state where the ink ID number cannot be input for the ink (here, the Y ink and the K ink) which is determined not to be supplemented. Thus, the operator confirms the label 164 of the ink bottle 160, inputs the ink ID number printed on the outside of the label 164, and then clicks the "TO NEXT" button displayed in the lower right corner of the picture.

Then, in the ink supplement process shown in FIG. 12, it is determined that the "TO NEXT" button is pressed down (yes in step S310), the input ink ID number is read (step S312), and then it is determined whether the read ink ID number is proper (step S314). The ink ID number seems to be a meaningless code formed by a plurality of numerals or alphabets when the operator gives a quick look at the ink ID number. However, the ink ID number is a kind of cryptogrammic data including the kind (color) of ink, a date (including a second time scale) stored in the ink bottle 160, or information such as the kind of usable ink jet printer 100. Only when the ink ID number is deciphered using specific key data, the information can be decoded and acquired.

When the printer driver 204 is installed on the computer 200, the key data is stored in the ROM of the computer 200. Therefore, when the ink ID number is read, the ink ID number is deciphered using the key data. As a consequence, when information (for example, the kind of ink or the kind of ink jet printer 100) obtained by completing the normal decipher is appropriate, it can be determined that the ink ID number is proper. On the other hand, when the ink ID number may not be deciphered or when the ink ID number can be first deciphered but, for example, the kind of ink or the kind of ink jet printer 100 differs from the actual kind of ink or ink jet printer so that various kinds of information obtained through the decipher is inconsistent, it can be determined that the ink ID number is not proper. In step S314 of the ink supplement process shown in FIG. 12, it is determined in this way whether the ink ID number is proper. Further, as described below, when the ink ID number is proper, but the once used ink ID number is re-input, it is determined that the ink ID number is not proper.

As a consequence, when it is determined that the input ink ID number is not proper (no in step S314), a picture prompting the operator to re-input the ink ID number is displayed on the monitor screen 202 (step S316), the process (step S310) of determining whether the "TO NEXT" button is pressed down is reiterated, and then the standby state is maintained.

Figure 17:
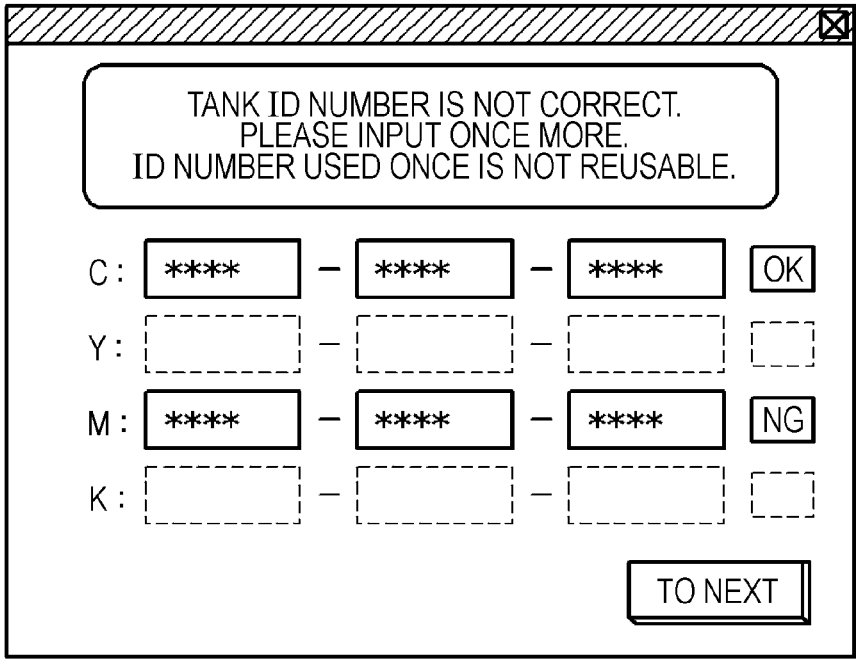
FIG. 17 is a diagram illustrating an example of a re-input picture displayed to prompt the operator to re-input the ink ID number on the monitor screen.

FIG. 17 is a diagram illustrating an example of the picture (re-input picture) displayed to prompt the operator to re-input the ink ID number on the monitor screen 202. As shown in FIG. 17, a determination result obtained by determining whether the ink ID number is proper is displayed in addition to the previously input ink ID number. For example, in the example shown in FIG. 17, for example, it is determined that the input ink ID number of the C ink is proper, whereas it is determined that the ink ID number of the M ink is not proper. Thus, the operator re-inputs the ink ID number of the M ink determined not to be proper, and then clicks the "TO NEXT" button. Then, the printer driver 204 reads the re-input ink ID number (step S312), and then determines whether the ink ID number is proper (step S314), even when determining that the "TO NEXT" button is pressed down (yes in step S310 in FIG. 12).

As a consequence, when it is determined that all of the ink ID numbers are proper (yes in step S314), the ink ID numbers determined to be proper are stored as the used ID numbers in the ROM of the computer 200 (step S316). The used ID numbers stored in this way are referred in the process of step S314 of determining whether the ink ID number is proper at the next time so that the input ink ID number can be correctly deciphered. Further, even when the deciphered details of the ink ID number are not inconsistent but the ink ID number is stored as the used ID number, it is determined that the ink ID number is not proper.

Subsequently, the printer driver 204 initializes the calculated remaining amount of ink countered by the control unit 140 of the ink jet printer 100 to the fullness state by transmitting the command to the control unit 140 of the ink jet printer 100 (step S320). When the calculated remaining amount of ink reaches the lower value limit, as described above with reference to FIG. 2, the control unit 140 of the ink jet printer 100 stops the operation of ejecting the ink from the ejection head 112. However, by transmitting the command from the printer driver 204 and initializing the calculated remaining amount of ink, it is possible to resume the printing. Accordingly, only when the input ink ID number is proper, the remaining amount of ink can be initialized, and thus the ink ID number corresponds to "initialization data" according to the invention.

Figure 18:
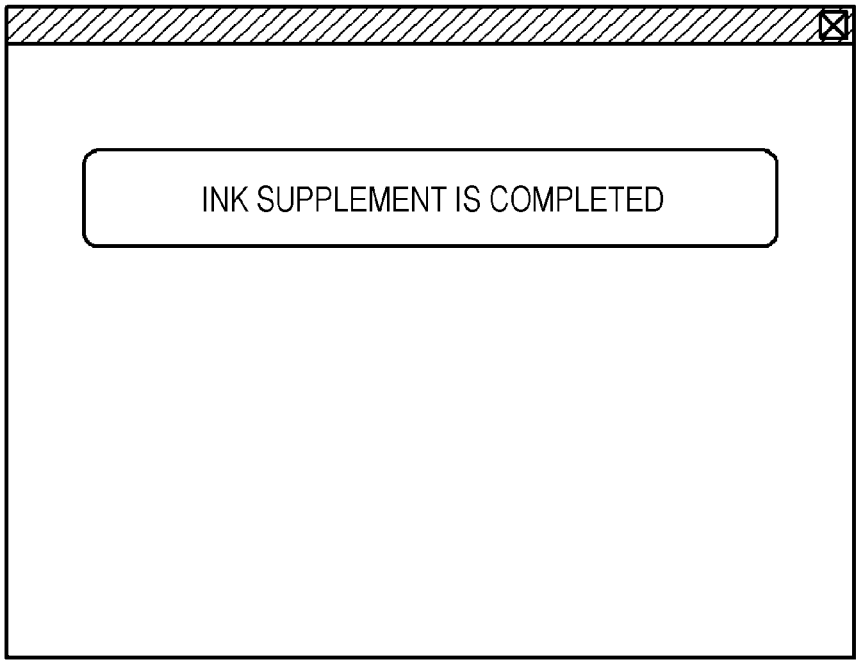
FIG. 18 is a diagram illustrating an example of a supplement completion picture displayed on the monitor screen.

When the calculated remaining amount of ink counted by the control unit 140 of the ink jet printer 100 is returned in this way, a picture (supplement completion picture) used to indicating that the ink supplement is completed is displayed on the monitor screen 202 (step S322). FIG. 18 is a diagram illustrating the supplement completion picture displayed on the monitor screen 202 of the computer 200. When the supplement completion picture is displayed in this way, the ink supplement process shown in FIG. 12 ends, the remaining ink amount management process is returned to the initial process of the remaining ink amount management process in FIG. 3, and then the above-described series of processes are reiterated.

In the printing system 10 according to this embodiment, as described above, the control unit 140 of the ink jet printer 100 counts the remaining amounts of ink based on the amounts of ink ejected from the ejection heads 112. The printer driver 204 of the computer 200 monitors the remaining amounts of ink in the ink tanks 151 by acquiring the remaining amounts of ink from the ink jet printer 100 while performing the above-described remaining ink amount management process. As a consequence, when the calculated remaining amount of ink is small, the operator is allowed to supplement the ink by performing the ink supplement process in FIG. 12. Further, when the calculated remaining amount of ink reaches the lower value limit, the operator is prompted to confirm the actual amount of ink remaining in the ink tank 151 by performing the remaining ink amount correction process in FIG. 6. When the ink actually remains, the calculated remaining amount of ink is made to approach the actual remaining amount of ink by increasing the calculated remaining amount of ink by the predetermined amount. Thus, irrespective of using the method of supplementing the ink into the ink tank 151 from the ink bottle 160, it is possible to prevent the inside of the ejection head 112 from being clogged due to the supplement of the ink which is not appropriate in its nature. Hereinafter, this point will be described.

As described above with reference to FIG. 2, the control unit 140 of the ink jet printer 100 counts the remaining amount of ink based on the dot data. Therefore, when the counted remaining amount of ink reaches the lower value limit, the operation of ejecting the ink from the ejection head 112 is stopped. Accordingly, in order to continue the printing, it is necessary to initialize the remaining amount of ink counted by the control unit 140 of the ink jet printer 100, and thus it is necessary to supplement the ink into the ink tank 151. When the operator supplements the ink, the picture used to input the ink ID number of the supplemented ink is displayed on the monitor screen 202. The printer driver 204 determines whether the input ink ID number is proper. Only when the ink ID number is proper, the remaining amount of ink is initialized so that the ink can be ejected again from the ejection head 112. That is, when the ink is supplemented into the ink tank 151, but the proper ink ID number is not input, the ink in the ink tank 151 may not be ejected from the ejection head 112.

The ink ID number is a kind of cryptogrammic data in which a plurality of numerals or alphabets seem to be meaninglessly arranged at a look, as described above. Therefore, it may not be possible to input the appropriate ink ID number, unless the operator does not input the ink ID number while viewing the ink ID number printed on the label 164 of the ink bottle 160. As a consequence, the operator spontaneously purchases the genuine ink bottle 160 (or the recommended ink jet printer 100 of a maker). Of course, it is unavoidable to use the ink ID number of the genuine ink bottle 160 once purchased several times, and thus supplement the ink of the improper nature. However, the ink ID number which is once determined to be proper and is input is stored as the used ink ID number. When this ink ID number is subsequently input, the ink ID number is determined not to be proper. Accordingly, since the ink is necessarily supplemented from the newly purchased genuine ink bottle 160 (or a recommended product of a maker), it is possible to prevent the ink of the improper nature from being supplied into the ejection head 112 and thus prevent the ejection head 112 from being clogged.

In the printing system 10 according to this embodiment, as described above with reference to FIGS. 4 and 5, when the ink level in the ink tank 151 is lowered up to the lower limit line 153, the picture used to select the ink to be supplemented is displayed on the monitor screen 202 (see FIG. 5). When all the ink in the ink bottle 160 is supplemented into the ink tank 151, the ink storage amount of the ink bottle 160 is set so that the ink level of the ink tank 151 is increased from the lower limit line 153 nearly to the upper limit line 157. Therefore, the operator spontaneously supplements all the ink in the ink bottle 160 when supplementing the ink. Further, as exemplified in FIG. 14, the message prompting the operator to supplement all the ink in the ink bottle 160 is displayed on the monitor screen 202, and thus the ink rarely remains in the ink bottle 160.

When the calculated remaining amount of ink counted by the control unit 140 of the ink jet printer 100 reaches the lower value limit, the remaining ink amount confirmation picture exemplified in FIG. 7 is displayed. Therefore, the operator can confirm whether the position of the ink level in the ink tank 151 reaches the lower limit line 153. When the ink level does not reach the lower limit line 153, the calculated remaining amount of ink is corrected so as to be increased by the predetermined amount. Thus, when the ink remains in the ink tank 151, the printing can be continuously performed by increasing the calculated remaining amount of ink by the predetermined amount. As a consequence, the ink is not supplemented in the much ink remains in the ink tank 151. In other words, the ink is supplemented after the ink in the ink tank 151 is nearly used up.

Accordingly, all the ink in the ink bottle 160 can be supplemented into the ink tank 151.

It is supposed that the ink tank 151 is fully filled with the ink and thus the ink remains in the ink bottle 160 before all the ink is supplemented into the ink bottle 160. Once even the genuine ink bottle 160 is opened, as described above, the nature of the ink in the ink bottle 160 gradually deteriorates over time. Therefore, when the ink bottle 160 is once opened, and then the ink remaining in the ink bottle 160 is supplemented, there is the concern that the inside of the ejection head 112 may be clogged. In the printing system 10 according to this embodiment, however, as described above, no ink remains in the ink bottle 160 when the operator supplements the ink. Accordingly, since the ink bottle 160 is once opened and thus the ink in the ink bottle 160 gradually deteriorates, it is possible to prevent the inside of the ejection head 112 from being clogged.

Since the ink ID number which is once input and received is not usable, as described above, the new ink bottle 160 is purchased necessarily at the subsequent supplement time. Further, when all the ink in the ink bottle 160 is injected, the ink level in the ink tank 151 reaches nearly the upper limit line 157. As exemplified in FIG. 14, the caution message is displayed on the monitor screen 202 so the ink level in the ink tank 151 does not exceed the upper limit line 157. Thus, even when the ink remains a little in the old ink bottle 160, it is possible to prevent the ink in the ink tank 151 from being supplemented and prevent the inside of the ejection head 112 from being clogged.

Further, it is assumed that the second ink bottle 160 is opened since all the ink in the first ink bottle 160 is supplemented but the ink tank 151 does not become a full state. In this case, the ink certainly remains in the second ink bottle 160. Since the ink ID number attached on the first ink bottle 160 can be input, the ink ID number of the second ink bottle 160 does not need to be used. Accordingly, when the ink remaining in the second ink bottle 160 is supplemented at the subsequent ink supplement and the ink ID number of the second ink bottle 160 is input, there is the concern that the ink deteriorating in its nature may be consequently supplemented and the ejection head 112 may be clogged. In this embodiment, in order to prevent this problem, the remaining amount of ink (the remaining amount of ink for which the check box is selectable on the supplement ink selection picture in FIG. 5) of the ink supplemented into the ink tank 151, the position of the upper limit line 157 of the ink tank 151, and the amount of ink stored in the ink bottle 160 are set so as to have the following relationship.

First, the remaining amount of ink (hereinafter, which is referred to as a "supplementary remaining amount of ink R") for which the check box is selectable on the supplement ink selection picture in FIG. 5 is set as the remaining amount of ink (hereinafter, which is referred to as an "increment remaining amount of ink dI") with respect to the ink (of which the ink level does not reach the lower limit line 153) selected on the remaining ink amount confirmation picture in FIG. 7. The reason is as follows.

Figure 19A:
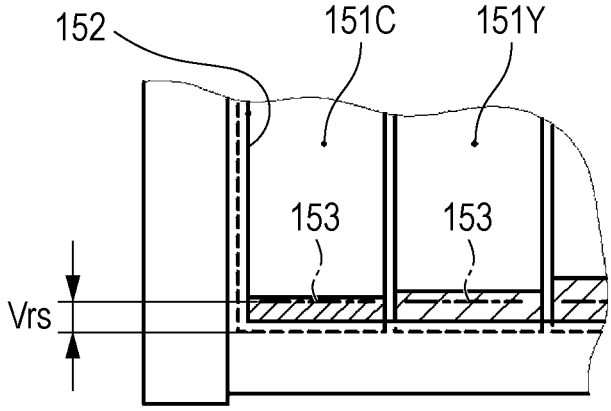
FIGS. 19A and 19B are diagrams for explaining a reason for setting the remaining amount of ink which can be supplemented into the ink tank so as to be the same as an increment amount of the remaining amount of ink for which the ink level does not reach the lower limit line.
Figure 19B:
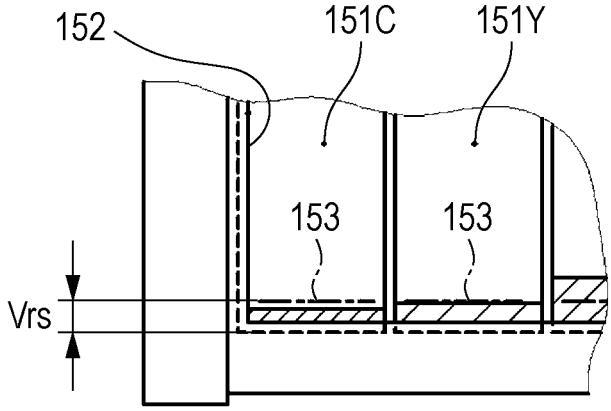

FIGS. 19A and 19B are diagrams for explaining the reason for setting the remaining amount of ink (supplementary remaining amount of ink R) of the ink which can be supplemented into the ink tank 151 so as to be the same as an increment amount (increment remaining amount of ink dI) of the remaining amount of ink for which the ink level does not reach the lower limit line 153. For example, it is assumed that when the calculated remaining amount of ink of given ink (here, the C ink) reaches the lower value limit, the ink level is shown as in FIG. 19A. That is, it is assumed that the ink level (here, the C ink) of which the calculated remaining amount of ink reaches the lower value limit is slightly higher than the lower limit line 153 and the ink (here, the Y ink) of which the calculated remaining amount of ink is slightly higher than this ink is present. In this case, since the ink level of the C ink is slightly higher than the lower limit line 153, it is assumed that the operator checks the check box on the remaining ink amount confirmation picture in FIG. 7. Then, the calculated remaining amount of C ink is increased only by the increment remaining amount of ink dI.

When the printing continues in this state, the calculated remaining amount of Y ink reaches the lower value limit and the remaining ink amount confirmation picture is displayed. Of course, the ink level of the C ink is lower than the lower limit line 153 since the ink level of the C ink is further lowered than that of the previous confirmation time. Accordingly, the operator will think to supplement the C ink. However, when the operator confirms the previous ink level, the remaining amount of C ink is increased. Therefore, the calculated remaining amount of ink does not yet reach the lower value limit. That is, when the position of the actual ink level is confirmed, the calculated remaining amount of ink is increased. However, it is necessary to supplement the ink in advance even when the calculated remaining amount of ink does not reach the lower value limit. Under to the most stringent condition, the ink may be supplemented immediately after the calculated remaining amount of ink is increased. Eventually, the ink may be supplemented even for the calculated remaining amount of ink (which is higher than the lower value limit only by the increment remaining amount of ink dI) immediately after the calculated remaining amount of ink is increased from the lower value limit. That is, the supplementary remaining amount of ink R (the remaining amount of ink for which the ink can be supplemented) may be set to a value which is the same as or larger than the remaining amount of ink obtained by adding the increment remaining amount of ink dI to the lower value limit. Further, as described above with reference to FIG. 10, the increment remaining amount of ink dI is the remaining amount of ink corresponding to the amount of ink (Vrs) of the reserved ink (the ink lower than the lower limit line 153) of the ink tank 151.

As described above, the supplementary remaining amount of ink R may be set to the value which is the same as or larger than the remaining amount of ink obtained by adding the increment remaining amount of ink dI to the remaining amount of ink of the lower value limit. According to this embodiment, however, the remaining amount of ink R is set to the value obtained by adding the increment remaining amount of ink dI to the lower value limit. The reason is as follows.

First, as an ideal case, it is assumed that the ink is supplemented from the ink bottle 160 when the remaining amount of ink reaches the lower value limit. In this case, the amount of ink remaining in the ink tank 151 at the time of supplementing the ink is the amount of ink when the ink level reaches the lower limit line 153. Therefore, this amount of ink is the amount of ink Vrs. Accordingly, the amount of ink in the ink tank 151 after the ink supplement is the amount of ink obtained by adding the amount of ink stored in the ink bottle 160 to the amount of ink Vrs of the reserved ink. Next, a case where the amount of ink of the ink tank 151 is the smallest at the time of supplementing the ink is a case where all the reserved ink is used up. In this case, the amount of ink of the ink tank 151 after the ink supplement is smaller by the amount of ink Vrs of the reserved ink than that of the ideal case. On the other hand, a case where the amount of ink of the ink tank 151 at the time of supplementing the ink is a case where the calculated remaining amount of ink just reaches the supplementary remaining amount of ink R. Accordingly, in this case, the amount of ink in the ink tank 151 after the ink supplement is the amount of ink larger by the amount of ink corresponding to the supplementary remaining amount of ink R compared to the ideal state. Further, an unbalance between the supplementary remaining amount of ink R and the actual amount of ink has to be taken into consideration. However, the unbalance is not taken into consideration herein, since the unbalance can be ignored.

Even when all the ink in the ink bottle 160 is supplemented, the ink level of the ink tank 151 needs not to exceed the upper limit line 157. Accordingly, the upper limit line 157 needs to be formed at a position higher by the amount of ink corresponding to the supplementary remaining amount of ink R than the position of the ink level as an ideal state (where the ink is supplemented when the ink level reaches the lower limit line 153). On the other hand, the ink level after the ink supplement may be lower by the amount of ink Vrs of the reserved ink than the ink level as the ideal state. In this case, even when all the ink in the ink bottle 160 is supplemented, the ink level is lower than the upper limit line 157. This difference corresponds to an amount of ink obtained by adding the amount of ink corresponding to the supplementary remaining amount of ink R to the amount of ink Vrs of the reserved ink. When this difference is too large, there is the concern that the ink may be supplemented from the second ink bottle 160 when the operator thinks that ink is short in spite of the fact that the ink in the first ink bottle 160 is supplemented. In order to prevent this problem, it is necessary to set the supplementary remaining amount of ink R to be as small as possible. In this embodiment, from this reason, the value of the supplementary remaining amount of ink R is set to the smallest value (that is, the same value as the increment remaining amount of ink dI) within an allowable range.

Second Embodiment

Hereinafter, a second embodiment of the invention will be described in the following order.

C. Apparatus Configuration

C-1. Configuration of Ink Jet Printer According to Embodiment

C-2. Configuration of Printing System According to Embodiment

D. Remaining Ink Amount Management process

D-1. Remaining Ink Amount Correction Process

D-2. Ink Supplement Process

C. Apparatus Configuration

C-1. Configuration of Ink Jet Printer According to Embodiment

Figure 20:
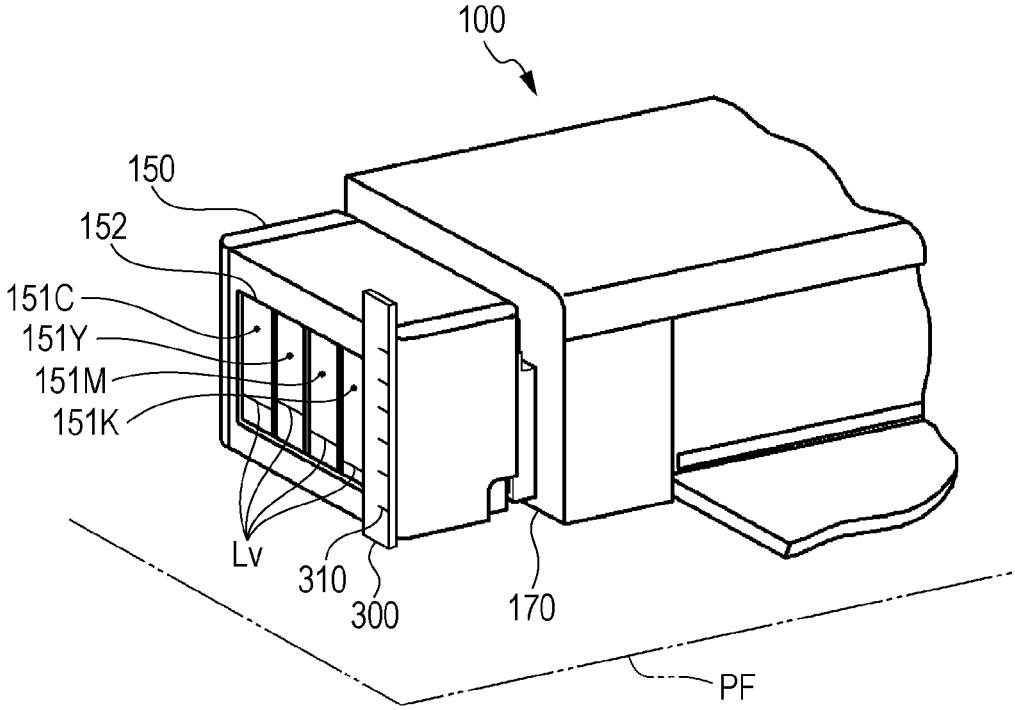
FIG. 20 is a diagram illustrating the remaining amounts of ink in the ink tanks when confirmed from the confirmation window of the tank case.

FIG. 20 is a diagram illustrating the configuration of an ink jet printer according to the second embodiment. In particular, the tank case 150 will be described.

Differences between the first and second embodiment are as follows.

As shown in FIG. 20, the ink tanks 151 of the second embodiment have no lower limit line which is formed in the ink tanks 151 of the first embodiment. Instead, when the operator confirms the actual remaining amount of ink remaining in the ink tanks 151, the operator can confirm the position (that is, which corresponds to the remaining amount of ink) of the ink level with a measurement tool. Specifically, the ink level is measured by the scale of a ruler. The ink jet printer of the second embodiment is different from that in that the ink jet printer includes a ruler accommodation portion accommodating the ruler used to measure the actual remaining amounts of ink stored in the ink tanks and the tank case is fixed to the ink jet printer.

The other configuration is the same as the configuration of the first embodiment. The configuration of the apparatus common to the configuration of the first embodiment and the remaining ink amount management process will not be described. Hereinafter, the configuration different from that of the first embodiment will be described.

The same reference numerals are given to the same constituent elements as those of the first embodiment in the drawings referred in the second embodiment.

As shown in FIG. 20, since a large confirmation window (opening) 152 is formed in the side surface of the tank case 150, the operator can view the ink tank 151C for the C ink, the ink tank 151Y for the Y ink, the ink tank 151M for the M ink, and the ink tank 151K for the K ink accommodated in the tank case 150. The ink tanks 151C, 151Y, 151M, and 151K are made of a transparent or semi-transparent resin material. Therefore, the operator can visually view and confirm the positions (that is, the remaining amounts of ink) of the ink levels Lv remaining in the ink tanks 151C, 151Y, 151M, and 151K.

As shown in FIG. 20, the ink jet printer 100 and the tank case 150 are placed on a plane surface PF. In this state, the operator can quantitatively confirm the ink levels Lv of the ink tanks 151 by taking out a ruler 300 accommodated in the ruler accommodation portion described below, placing one end of the ruler 300 on the plane surface PF, confirming the scale 310 of the ruler 300 corresponding to the ink levels remaining in the ink tanks 151C, 151Y, 151M, and 151K.

In this way, the positions of the remaining amounts of ink corresponding to the lower limit line of the first embodiment cam be confirmed. In this embodiment, the scale 310 is formed at a 10 mm interval in consideration of the precision necessary for quantitatively confirming the ink levels Lv of the ink tanks. In this embodiment, it is assumed that the position of 20 mm from the plane surface PF is the position corresponding to the lower limit line of the first embodiment. The operator can decide whether it is necessary to correct the remaining amount of ink counted by the control unit 140 and supplement the ink into the ink tank 151 by measuring the ink level Lv with the ruler 300.

Fixing Ruler Accommodation Portion and Tank Case to Ink jet Printer

Figure 21:
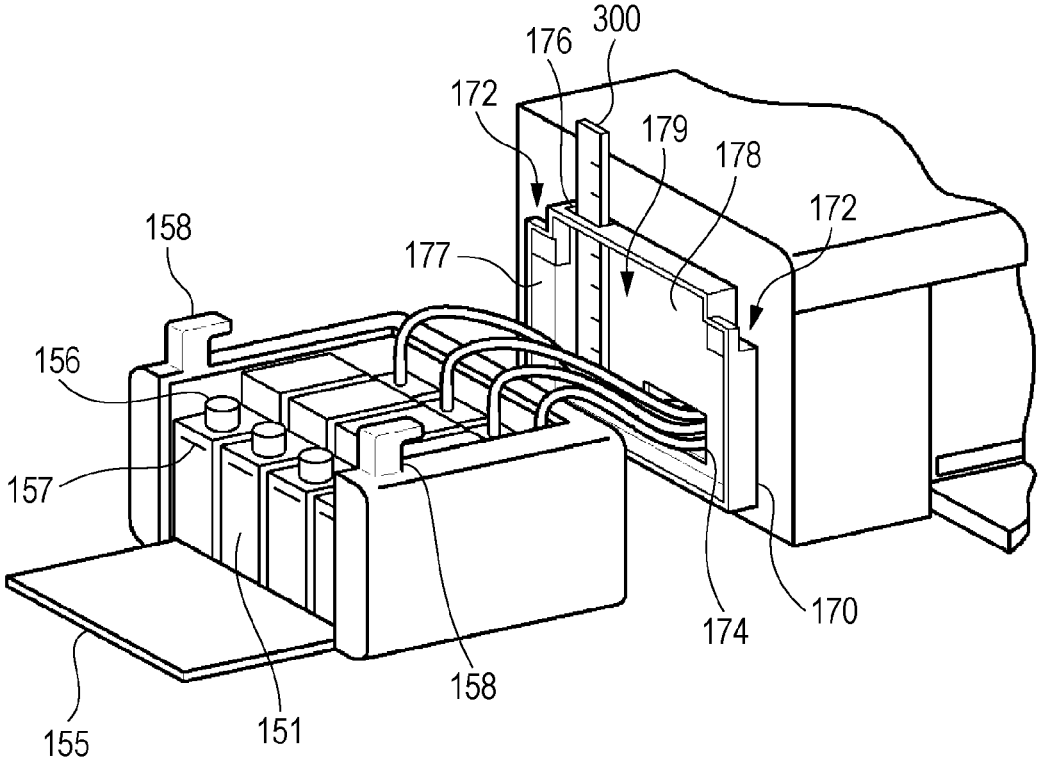
FIG. 21 is a diagram illustrating the tank case detached from the ink jet printer.

FIG. 21 is a diagram illustrating a configuration where the tank case 150 is fixed to the ink jet printer 100. In FIG. 21, after the tank case 150 is detached, the tank case 150 is rotated so that the side surface of the tank case 150 mounted on the ink jet printer 100 faces upward. As shown in FIG. 21, two hooks 158 on the upper surface side of the tank case 150 are erected on the surface of the tank case 150 mounted on the ink jet printer 100. A fixing cover 170 is installed on the side surface (the surface on which the tank case 150 is mounted) of the ink jet printer 100. In the fixing cover 170, fixing portions 172 are formed at the positions corresponding to the positions of the hooks 158.

In the fixing cover 170, a concave portion 179 is formed by a bottom portion 178 and a wall portion 177 erected from the outer circumference of the bottom portion 178. The concave portion 179 functions as the "ruler accommodation portion" that accommodates the ruler 300. Accordingly, the concave portion 179 is also referred to as a ruler accommodation portion 179. A guide opening 176 guiding the ruler 300 to the ruler accommodation portion 179 is formed at the position of the wall portion 177 adjacent to one of the fixing portions 172. Along the guide opening 176, the ruler 300 can be accommodated in the ruler accommodation portion 179 and the ruler 300 can be taken out from the ruler accommodation portion 179. As shown in FIG. 21, it is not necessary to accommodate the entire ruler 300 in the ruler accommodation portion 179. Even when a part of the ruler 300 exceeds the ruler accommodation portion 179, the posture of the ruler 300 may be stabilized.

Next, the fixing of the tank case 150 to the ink jet printer 100 will be described. In order to fix the tank case 150 to the ink jet printer 100, the tank case 150 is lifted so that the hooks 158 are located slightly above the fixing portions 172, and then the tank case 150 is moved downward at this time in the direction of the plane surface PF on which the ink jet printer 100 is placed. In this way, the hooks 158 engage with the fixing portions 172 from the upper side, so that the tank case 150 is mounted on the ink jet printer 100.

When the remaining amount of ink in the ink tank 151 becomes small during the printing in the state where the tank case 150 is mounted on the ink jet printer 100, the ink is supplemented into the ink tank 151 in accordance with the guide of the remaining ink amount management module, as in the first embodiment. First, the tank case 150 is lifted upward to detach the tank case 150 from the fixing cover 170, and then the tank case 150 is made to fall down so that the surface on the side of the ink jet printer 100 faces upward, as shown in FIG. 21. Then, when the upper surface cover 155 installed on the upper surface of the tank case 150 is made to fall down, the cap 156 installed on the upper surface of the ink tank 151 can easily be detached. Therefore, the cap 156 is detached and the ink is supplemented from the ink bottle 160 into the ink tank 151.

Figure 22:
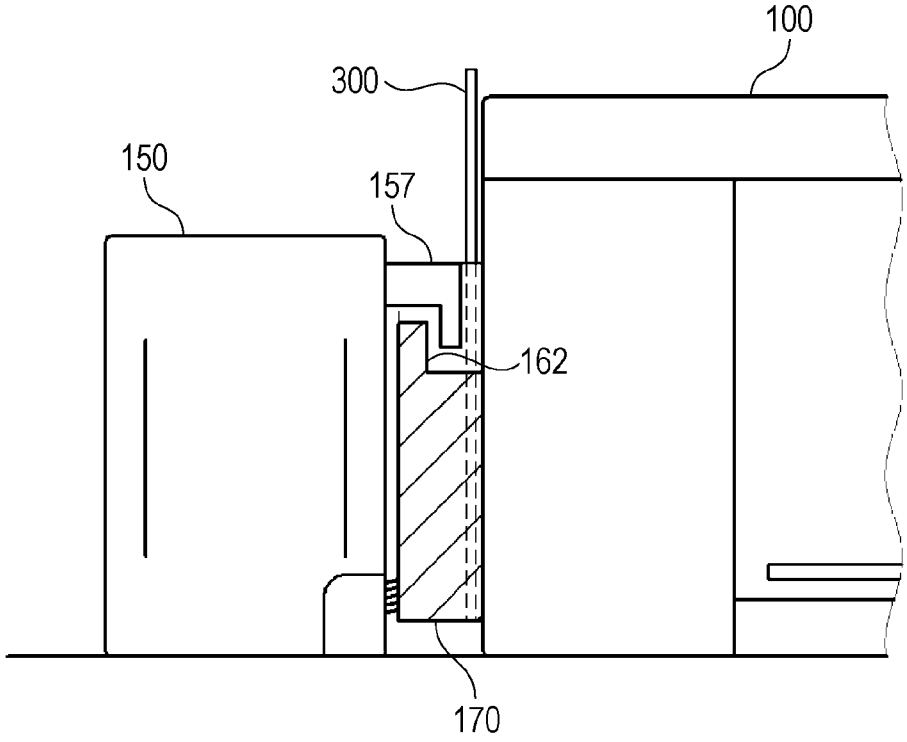
FIG. 22 is a diagram illustrating a configuration where the tank case is fixed to the ink jet printer.

FIG. 22 is an enlarged view illustrating the portion in which the hooks 158 of the tank case 150 and the fixing portions 172 of the fixing cover 170 engage with each other in the state where the ink jet printer 100 is placed on the plane surface PF. As shown in FIG. 22, in the ink jet printer 100 according to this embodiment, the bases of the hooks 158 of the tank case 150 are configured to be slight higher than the positions of the front ends of the fixing units 172 of the fixing cover 170 in the state where the tank case 150 and the ink jet printer 100 are placed on the ground surface. Therefore, in the state where the ink jet printer 100 is placed on the ground surface, the tank case 150 is independently placed, so that the weight of the tank case 150 is not applied to the fixing cover 170 for most of the time (time in which the ink jet printer 100 is placed on the plane surface PF). Accordingly, it is possible to prevent a crack from being formed in the ink jet printer 100 due to creep occurring since the weight of the tank case 150 is applied to the ink jet printer 100 via the fixing cover 170.

C-2. Configuration of Printing System According to Embodiment

Since the configuration of the printing system including the ink jet printer according to the second embodiment is the same as that of the first embodiment, the description thereof will not be repeated.

D. Remaining Ink Amount Management Process

D-1. Remaining Ink Amount Correction Process

Figure 23:
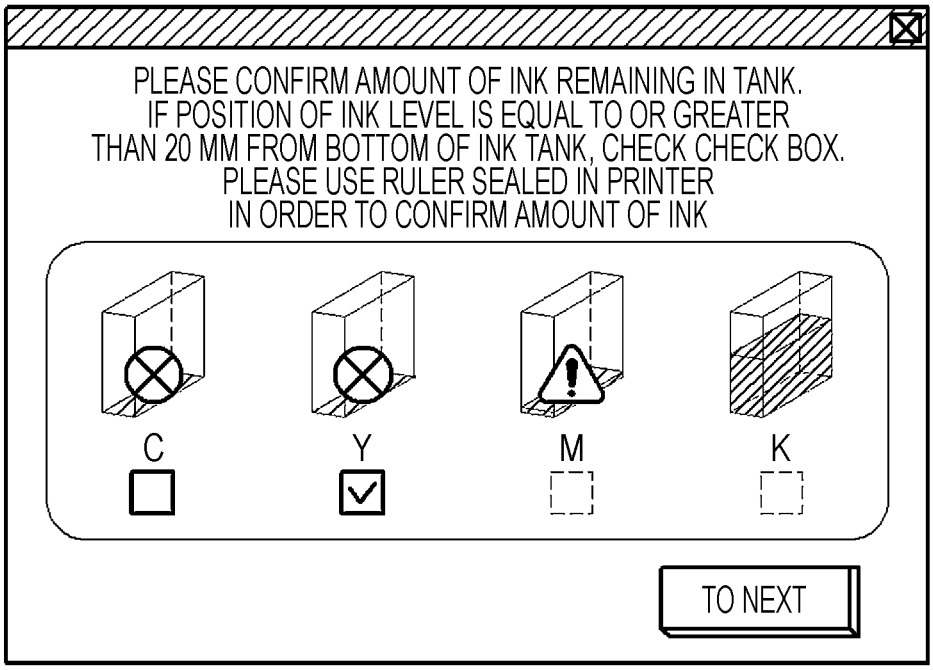
FIG. 23 is a diagram illustrating an example of the remaining ink amount confirmation picture displayed on the monitor screen.

The remaining ink amount processes performed by the printer driver 204 according to the second embodiment are the same as the processes described in the flowcharts of FIGS. 3 and 6 according to the first embodiment. However, the operator is prompted to confirm the actual ink remaining amount by the use of the ruler in the second embodiment, whereas the operator can confirm the position of the remaining amount of ink stored in the ink tank 151 with respect to the lower limit line of the ink tank 151 when the operator is prompted to confirm the actual remaining amount of ink in the first embodiment. Thus, in the second embodiment, the remaining ink amount confirmation picture displayed in step S202 is different. FIG. 23 is a diagram illustrating the remaining ink amount confirmation picture displayed on the monitor screen 202 according to the second embodiment. The image roughly indicating the remaining amount of ink is displayed and the square check box is displayed below the image indicating the remaining amount of ink, as in the first embodiment. A message displayed on the image indicating the remaining amount of ink is as follows: "Please confirm the amount of ink remaining in the tank. If the position of the ink level is equal to or greater than 20 mm from the bottom of ink tank, check the check box. Please use a ruler sealed in the printer in order to confirm the amount of ink".

Instead of using the ink level with reference to the lower limit line in the first embodiment, the ink level is confirmed with the ruler in the second embodiment. The subsequent processes and the advantages are the same as those of the first embodiment.

In the ink supplement process, the process of "releasing the lock of the tank case" is performed in the first embodiment, whereas this process is omitted in the second embodiment.

D-2. Ink Supplement Process

Since the ink supplement process of the second embodiment is the same as the ink supplement process of the first embodiment, the description thereof will not be repeated.

E. Modified Examples

In the printing system 10 according to the above-described first and second embodiments, the case has hitherto been described in which the printer driver 204 performs the remaining ink amount management process in FIG. 3 on the computer 200. However, the ink jet printer 100 may includes the control unit 140 that includes a CPU, a RAM, and a ROM, the monitor screen 104, and the operation button 105. Thus, the control unit 140 of the ink jet printer 100 may perform the remaining ink amount management process in FIG. 3 on the ink jet printer 100.

The ruler with the scale has been used as the measurement tool according to the related art in the second embodiment. However, the measurement tool is not limited to the ruler. For example, an object with the height corresponding to the lower limit line from the plane surface PF may be used, or a block or the like may be used.

The various embodiments have hitherto been described, but the invention is not limited to the above-described embodiment. The invention is modified in various forms without departing from the gist of the invention.

The entire disclosure of Japanese Patent Application Nos. 2010-186922, filed Aug. 24, 2010 and 2011-004591, filed Jan. 13, 2011 are expressly incorporated by reference herein.

What is claimed is:

1. A computer-readable medium storing thereon a program, the program causing a computer to control an operation of a printing apparatus, which includes an ink tank which is able to be supplemented with ink from the outside and an ejection head which ejects the ink supplied from the ink tank and which has a function of stopping ejecting the ink from the ejection head when a count value of an amount of ink supplied from the ink tank reaches a value limit, the program causing the computer to realize:

a first function of acquiring, from the printing apparatus, information used to determine whether the count value reaches the value limit;

a second function of displaying a confirmation image to prompt an operator of the printing apparatus to visually confirm an amount of ink in the ink tank, when the count value reaches the value limit; and a third function of instructing the printing apparatus to perform a correction operation of returning the count value from the value limit by a predetermined value depending on selection of the operator of the printing apparatus after the display of the confirmation image.

2. The computer-readable medium according to claim 1, wherein the second function displays an image to prompt the operator to determine whether it is necessary to supplement the ink, and wherein the third function allows the printing apparatus to perform an initial operation to initialize the count value when the operator selects the supplement of the ink.

3. The computer-readable medium according to claim 1, wherein the ink tank is configured such that a position of a ink level is visually viewed in the ink tank and has a lower limit line, which is used to determine whether it is necessary to supplement the ink in comparison to the position of the ink level, wherein the second function displays, as the confirmation image, an image to prompt the operator of the printing apparatus to determine whether it is necessary to supplement the ink by comparing the lower limit line to the position of the ink level in the ink tank, and wherein the third function allows the printing apparatus to perform the initial operation when the operator selects the supplement of the ink, whereas allowing the printing apparatus to perform the correction operation when the operator selects non-supplement of the ink.

4. The computer-readable medium according to claim 3, wherein the ink tank stores a predetermined amount of ink below the lower limit line as reserved ink, and wherein the third function allows the printing apparatus to perform, as the correction operation, an operation of returning the count value in the printing apparatus from the value limit by a count value corresponding to the amount of reserved ink.

5. The computer-readable medium according to claim 1, wherein the printing apparatus includes a plurality of the ink tanks, each of which includes the ejection head, and has a function of stopping ejecting the ink for each of the ink tanks when the amount of ink counted for each ink tank reaches the value limit, wherein the first function is a function of acquiring information used to determine whether the count value of the amount of ink reaches the value limit for each ink tank, wherein the second function is a function of displaying the confirmation image for the ink tank in which the count value reaches the value limit, and wherein the third function is a function of allowing one of the initialization operation to initialize the count value and the correction operation on each ink tank depending on selection of the operator of the printing apparatus for the ink tank displayed with the confirmation image.

6. A printing system comprising:

a printing unit having ejection head to eject ink supplemented from the outside to an ink tank; and a control unit controlling an operation of the printing unit, wherein the control unit includes an ink amount count unit counting an amount of ink supplied from the ink tank to the ejection head in the printing unit as a count value, an ejection stop unit stopping ejecting the ink from the ejection head, when the count value reaches a predetermined value limit, a confirmation image display unit displaying a confirmation image to prompt an operator of the printing system to visually confirm the amount of ink in the ink tank, when the count value reaches the value limit, and a count value change unit performing an operation of returning the count value to an initial value of the count value or returning the count value from the value limit by a predetermined value depending on selection of the operator of the printing system after the display of the confirmation image.

7. A computer-readable medium storing thereon a program, the program causing a computer to control an operation of a printing apparatus, which includes an ink tank which is able to be supplemented with ink from the outside and an ejection head which ejects the ink supplied from the ink tank and which has a function of stopping ejecting the ink from the ejection head when a count value of an amount of ink supplied from the ink tank reaches a value limit, wherein the ink tank is configured such that a position of an ink level is visually viewed in the ink tank and has a lower limit line, the program causing the computer to realize:

a first function of acquiring, from the printing apparatus, information used to determine whether the count value reaches the value limit;

a second function of displaying a message to confirm whether an ink level reaches the lower limit line or not and of displaying a check box, a third function of determining whether the check box is checked or not and instructing the printing apparatus to perform the correction operation of returning the count value from the value limit by a predetermined value if the check box is checked.

8. The computer-readable medium according to claim 7, the program further causing the computer to realize a fourth function of displaying an image to prompt the operator of the printing apparatus to determine whether it is necessary to supplement the ink tank with the ink, and a fifth function of instructing the printing apparatus to perform the initial operation to initialize the count value when the operator selects the supplement of the ink.

* * * * *